US006992877B2

(12) United States Patent
DeVries et al.

(10) Patent No.: US 6,992,877 B2
(45) Date of Patent: Jan. 31, 2006

(54) ELECTRONIC SWITCHING SYSTEM FOR A DETONATION DEVICE

(75) Inventors: Derek DeVries, Farr West, UT (US); James Aadland, Roy, UT (US); Daniel Holmes, Logan, UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 10/386,578

(22) Filed: Mar. 12, 2003

(65) Prior Publication Data

US 2004/0020392 A1 Feb. 5, 2004

Related U.S. Application Data

(60) Provisional application No. 60/364,855, filed on Mar. 13, 2002.

(51) Int. Cl.
*F23Q 3/00* (2006.01)

(52) U.S. Cl. ..... 361/248; 361/247

(58) Field of Classification Search ..... 361/248, 361/249, 250, 251, 253, 252, 247, 256, 257; 102/202, 206, 211, 215, 200
See application file for complete search history.

(56) References Cited

U.S. PATENT DOCUMENTS 4,106,073 A * 8/1978 Hedberg ..... 361/248
4,699,241 A * 10/1987 Kerekes ..... 181/116
4,708,060 A 11/1987 Bickes, Jr. et al.
5,063,846 A 11/1991 Willis et al.
5,245,926 A 9/1993 Hunter
5,444,598 A * 8/1995 Aresco ..... 361/253
5,460,093 A * 10/1995 Prinz et al. ..... 102/217
5,585,592 A * 12/1996 Stearns et al. ..... 102/233
5,587,550 A 12/1996 Willis et al.
5,705,766 A * 1/1998 Farace et al. ..... 102/215
5,929,368 A 7/1999 Ewick et al.
6,085,659 A * 7/2000 Beukes et al. ..... 102/206
6,173,651 B1 1/2001 Pathe et al.
6,199,484 B1 3/2001 Martinez-Tovar et al.
6,298,924 B1 * 10/2001 Vaynshteyn et al. ..... 175/4.54

* cited by examiner

*Primary Examiner*—Brian Sircus
*Assistant Examiner*—Danny Nguyen
(74) *Attorney, Agent, or Firm*—TraskBritt

(57) ABSTRACT

An apparatus for electronically switching a detonation device is configured to arm an energy source upon receiving a first signal and discharge the energy source to the detonation device upon receiving and validating a second signal. An explosive device comprising a detonation device electrically coupled to an electronic switching device is also provided, wherein the switching device comprises a microcontroller configured to validate the first signal and the second signal. The detonation device may comprise a semiconductor bridge device configured to activate the explosive device upon receiving a charge across a first terminal and a second terminal from the switching device. Methods of operation are also disclosed.

28 Claims, 33 Drawing Sheets

ELECTRONIC SWITCHING SYSTEM FOR A DETONATION DEVICE

CROSS-REFERENCE TO RELATED APPLICATIONS

The present application claims the benefit of U.S. provisional patent application Ser. No. 60/364,855 entitled ELECTRONIC SWITCHING SYSTEM AND RELATED METHOD, filed Mar. 13, 2002, the disclosure of which is hereby incorporated herein.

BACKGROUND OF THE INVENTION

Field of the Invention: The present invention pertains generally to electrical or electronic switching apparatus and related methods. More specifically, the present invention relates to such switching devices and methods useful for arming and fire control of an explosive or pyrotechnic actuation or detonation device or the like, such as "safe and arm" systems.

State of the Art: There are many applications in which explosive or pyrotechnic actuation or detonation devices are used and wherein an explosive or pyrotechnic charge is detonated using an electrical or electronic switching device for actuation. Examples include such things as automotive airbag initiators, parachute harness connectors, and the like. In such devices, the switching device generally performs the functions of arming the device and, upon the appropriate instruction, applying electrical energy to the device to cause the explosive or pyrotechnic charge to detonate. In many applications, such as those in which the device is portable, this involves charging a capacitive device and then discharging the electrical energy in the capacitive device into the ignition or detonation apparatus. Examples of such devices are disclosed in U.S. Pat. No. 5,063,846, issued to Willis et al. on Nov. 12, 1991; U.S. Pat. No. 5,245,926, issued to Hunter on Sep. 21, 1993; U.S. Pat. No. 5,587,550, issued to Willis et al. on Dec. 24, 1996; and U.S. Pat. No. 6,173,651 issued to Pathe et al. on Jan. 16, 2001.

In many known switching devices of this type, a mechanical safe and arm device has been used to initiate a detonator or ordnance train comprising an explosive transfer system or line, which in turn initiates an initiator. In recent years, the use of semiconductor bridges as part of the initiator device has increased. Examples of such semiconductor bridge initiators are provided in U.S. Pat. No. 5,929,368, issued to Ewick et al. on Jul. 27, 1999 and U.S. Pat. No. 6,199,484, issued to Martinez-Tovar et al. on Mar. 13, 2001.

Although such systems generally have proven to be reliable, they often impose undesirable size, weight and/or cost penalties. The cost penalties may include not only the cost of the components themselves, but also parts and associated logistical costs, assembly costs, etc.

With any safe and arm system, safety and reliability are of paramount concern. Accordingly, any system that vies as a candidate to replace existing safe and arm systems must have sufficient safety and reliability engineered into the system. It is also important in many applications to have the ability to monitor all aspects of the system, or at least critical component status. Many existing systems, such as those described above, have only a limited capability to monitor system status, for example, only to the safe and arm component.

BRIEF SUMMARY OF THE INVENTION

The present invention comprises an electronic switching device. According to an exemplary embodiment of the present invention, the switching device comprises a discharge energy source, charge switching circuitry configured to selectively charge the energy source, a high-side fire circuit configured to discharge the energy source to an actuation or detonation device, and fire signal verification circuitry configured to allow the high-side fire circuit to discharge the energy source upon validation of a fire signal. The switching device may further comprise an arm signal input, a power supply and voltage converter, a microcontroller, a fire signal input, blocking circuitry, and a high-low differential switching circuit. An explosive or pyrotechnic device comprising an actuation or detonation device coupled to an electronic switching device according to the present invention is also encompassed by the present invention.

A method for electronically switching an actuation or detonation device is provided according to an exemplary embodiment of the present invention, the method comprising entering an operational mode upon receiving an arm signal, receiving a fire signal, validating the fire signal, and applying energy to the actuation or detonation device.

The switching device and method may be configured such that they comprise output surge suppression and a master clear that automatically operate on the input voltage of the system to wait until it is stable before activating the microcontroller. The switching device and method may also comprise a removable actuation or detonation device, or semiconductor bridge hereinafter "SCB") device.

In accordance with another aspect of the present invention, over-voltage protection may be provided in the power supply. The switch and method may also comprise a safety switch on the high-side fire switching circuit.

In accordance with another aspect of the present invention, an SCB monitoring circuit is provided.

The present invention advantageously provides an electronic switching system and related method that can be made small relative to many existing systems of this type. It is another advantage of the present invention wherein an electronic switching system and related method are provided that can be made lightweight relative to many conventional switching systems. The present invention includes a further advantage of providing an electronic switching system and related method that can be made and maintained inexpensively relative to many conventional switching systems. In yet another advantage of the present invention, an electronic switching system and related method are provided that offer enhanced reliability and enhanced monitoring capability relative to many conventional switching systems.

Additional features and advantages of the invention will be set forth in the description which follows and, in part, will be apparent to those of ordinary skill in the art from the description, or may be learned by practice of the invention. The features and advantages of the invention may be realized and obtained by means of the instrumentalities and combinations pointed out in the appended claims.

BRIEF DESCRIPTION OF THE DRAWINGS

The accompanying drawings, which are incorporated in and constitute a part of the specification, illustrate what are currently considered to be best modes for carrying out the invention.

DETAILED DESCRIPTION OF THE INVENTION

Figure 1:
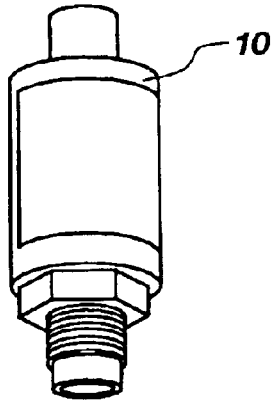
FIG. 1 is a perspective view of an electronic switching device according to one embodiment of the present invention.

Reference will now be made in detail to the embodiments and methods of the present invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section. The invention according to its various aspects is particularly pointed out and distinctly claimed in the attached claims read in view of this specification and appropriate equivalents.

Figure 2:
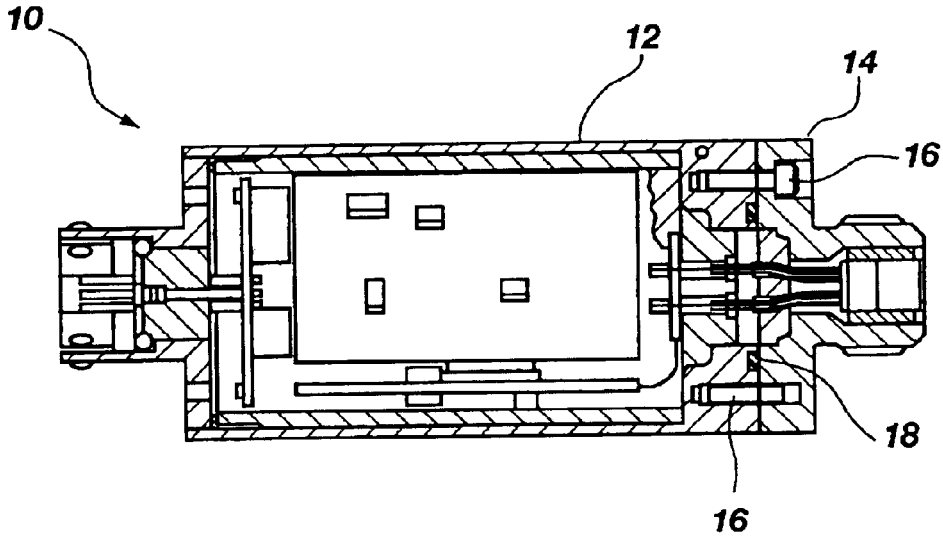
FIG. 2 is an internal cutaway or assembly view of the electronic switching device shown in FIG. 1.

A switching device 10, according to an embodiment of the present invention, is shown in perspective view in FIG. 1. FIG. 2 is an assembly drawing for the switching device 10 shown in FIG. 1. As shown in FIG. 2, the switching device 10 comprises an electronics module 12 electronically coupled to an initiator assembly 14. The initiator assembly 14 may be referred to herein as a "detonation device" and may comprise, by way of example only, an SCB device. The initiator assembly 14 may be detachably attached to the electronics module 12 using a plurality of fasteners 16 (two shown), such as cap screws. A sealing device 18, such as an o-ring, may be used to form a seal between the electronics module 12 and the initiator assembly 14 to protect the electronics module 12 from explosive materials, pyrotechnic materials, or atmospheric conditions to which the initiator assembly 14 may be exposed.

Figure 3:
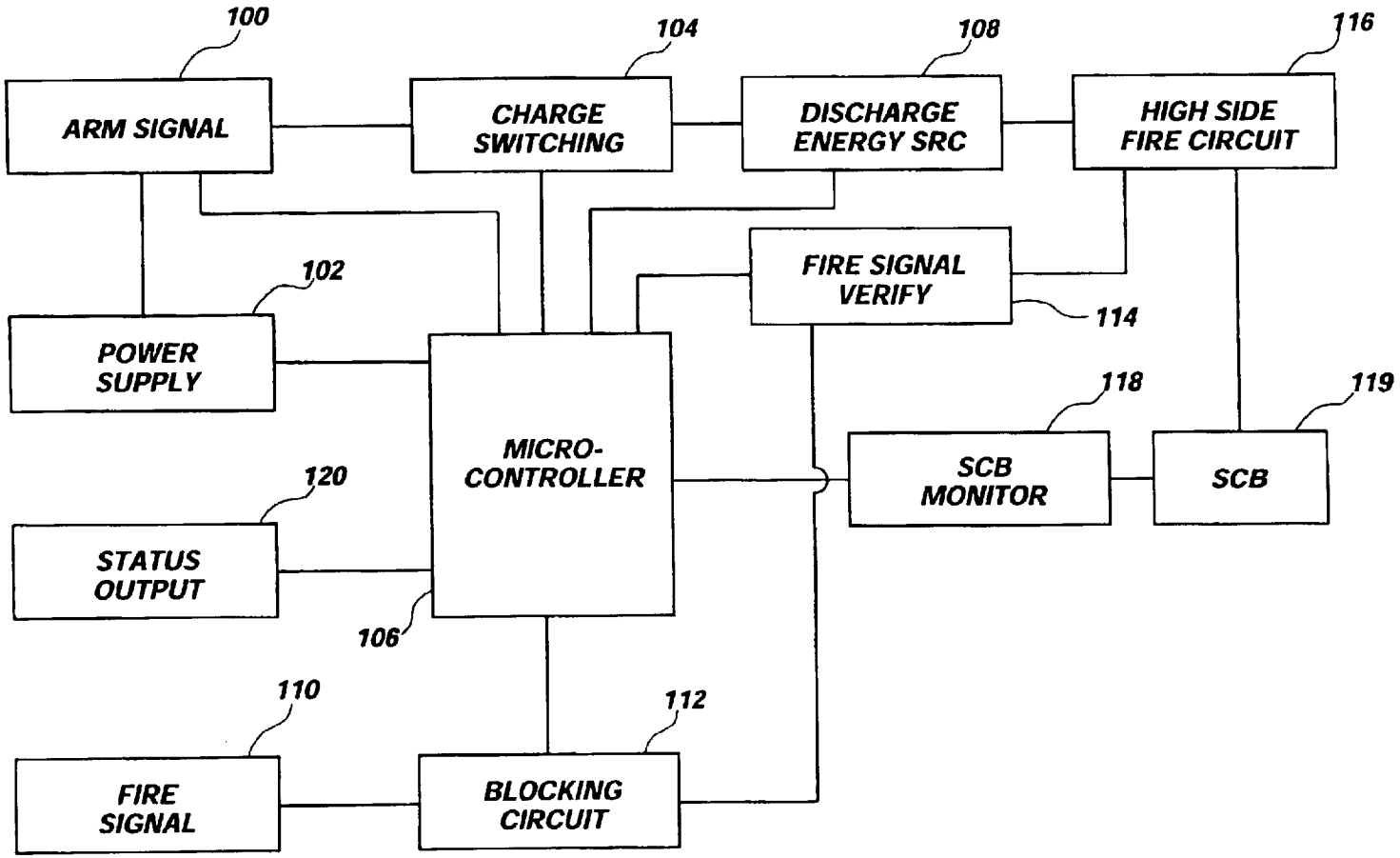
FIG. 3 is a block diagram of the electronic switching device shown in FIG. 1.

A generalized hardware block diagram outlining principle circuit components of the switching device 10 is shown in FIG. 3 and general interrelationships among the circuit components are provided. From this perspective, the switching device 10 includes an arm signal input 100, a power supply and voltage converter 102 (also referred to herein as the "power supply"), charge switching circuitry 104, a microcontroller 106, a discharge energy source 108, a fire signal input 110, a blocking circuit 112, a fire signal verification circuit 114, a high-side fire circuit 116, a high-low differential switching circuit 118 (also referred to herein as a "detonator monitoring circuit" or an "SCB monitor") SCB 119, and status output circuit 120.

Figure 4A:
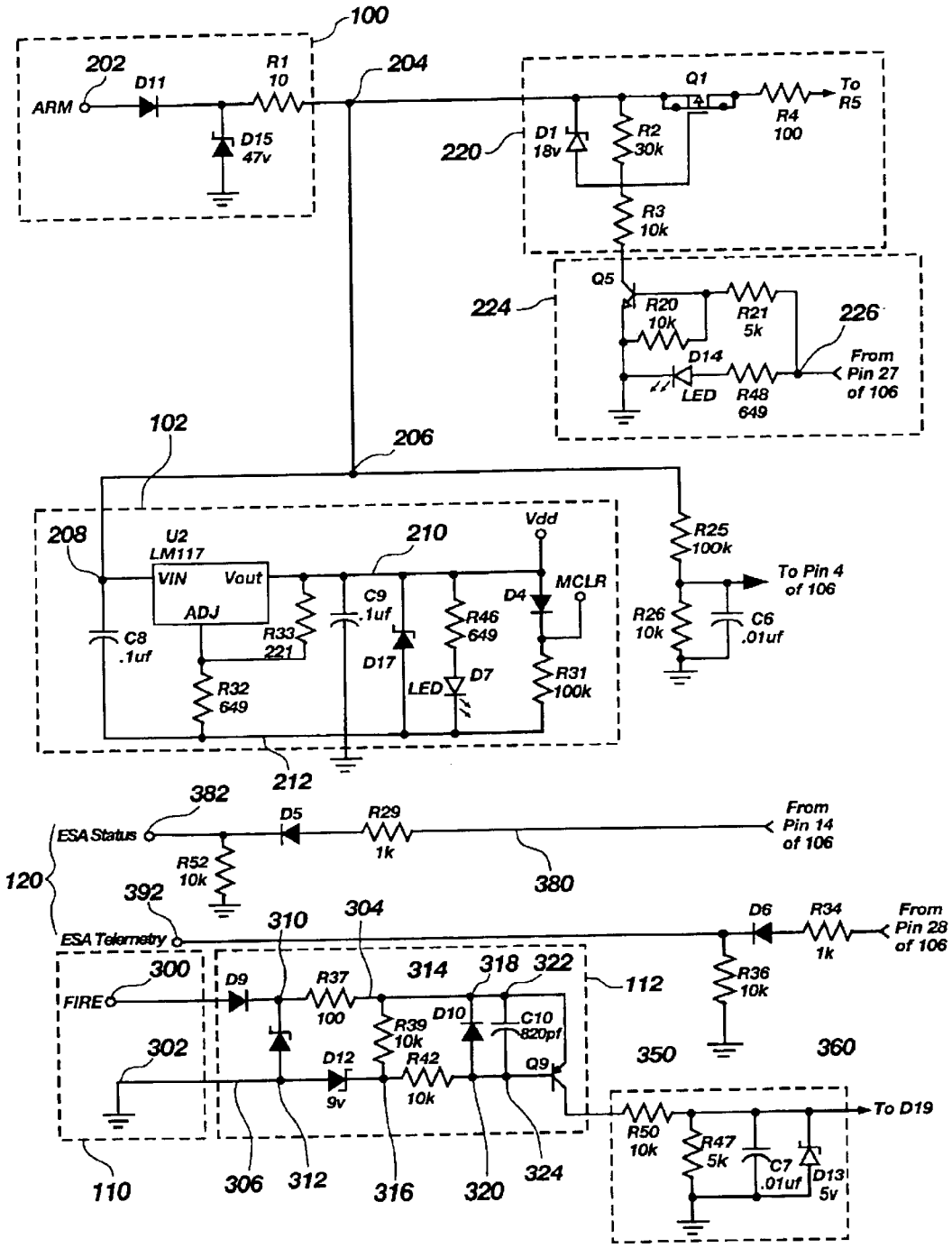
FIGS. 4A through 4C are schematic diagrams of the circuitry for the electronic switching device shown in FIG. 1.
Figure 4B:
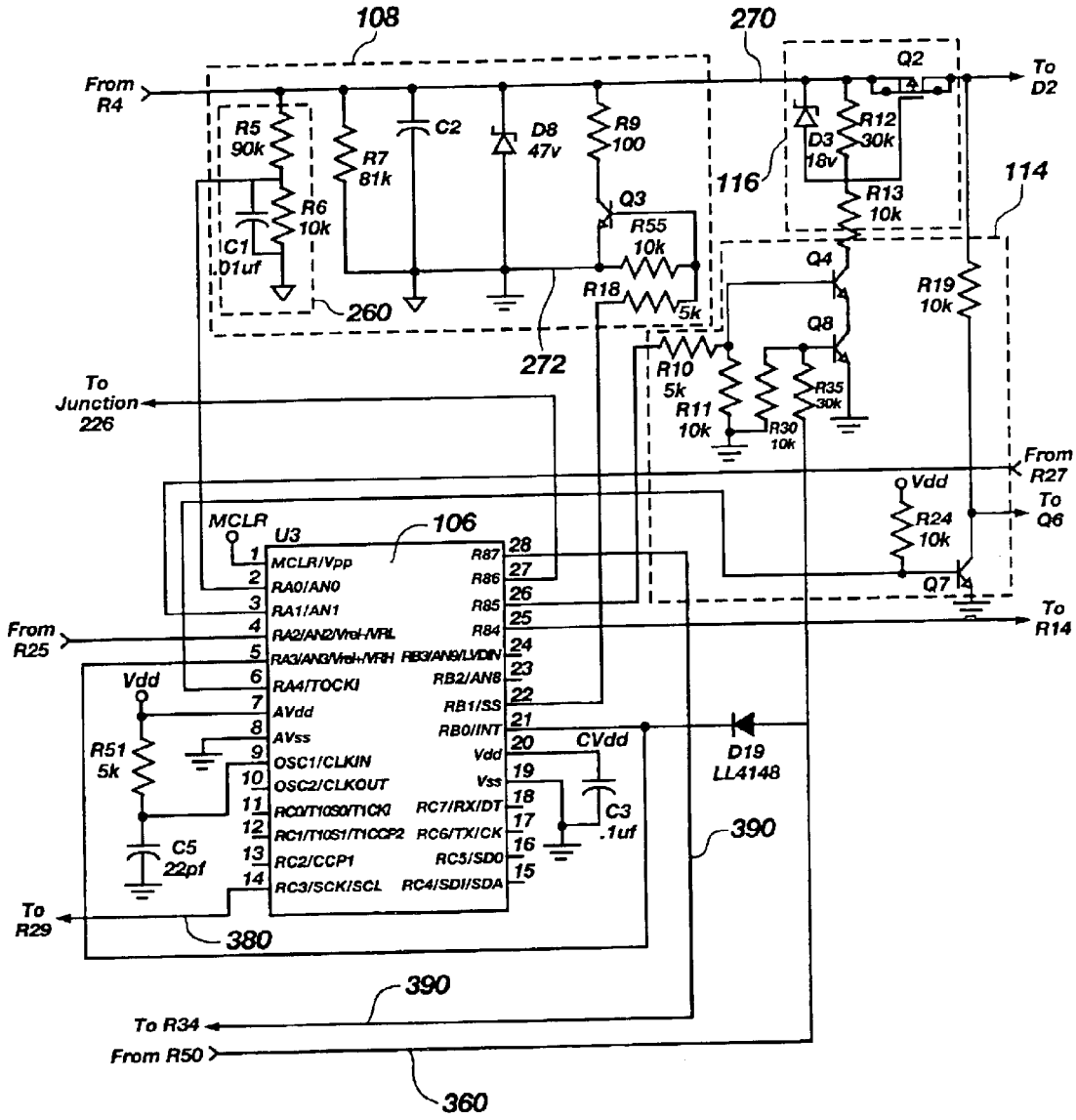

FIGS. 4A through 4B show an electrical schematic diagram of the circuitry comprising the switching device 10 shown in FIG. 3. As shown in FIG. 4A the arm signal input portion 100 of the switching device 10 comprises an arm signal input terminal 202 that is coupled to an arm signal source (not shown). The specific arm signal source for a given design will depend upon the particulars of the application and the desired arming mechanism. In the currently preferred embodiment, the arm signal is generated by contact of water with an actuator, which causes an electrical signal ("ARM") to be impressed upon arm signal input terminal 202. The arm signal input in this embodiment is a direct current ("DC") signal. Terminal 202 is coupled to the anode of a diode D11. The cathode of the diode D11 is coupled to junction 204 through a resistor R1. A Zener diode D15 couples the cathode of diode D11 and resistor R1 to ground to provide surge suppression. Junction 204 is coupled to a junction 206 leading to power supply 102. Junction 206 more specifically is coupled to a junction 208 of the power supply 102.

The power supply 102 provides power to other components of the switching device 10, including the microcontroller 106 (shown in FIG. 4B) that largely controls the operation of the switching device 10, as will be described in greater detail below. In this preferred embodiment, power supply 102 comprises a power supply chip U2 (LM-117) which has an input Vin coupled to junction 208. Input Vin is also coupled to a 0.1 microfarad ("$\mu$f") capacitor C8. Power supply 102 comprises an upper bridge 210 and a lower bridge 212. The lower bridge 212 is coupled to ground. The upper bridge 210 and the lower bridge 212 are coupled to capacitor C8 from junction 208. The power supply chip U2 is disposed with its conduction path, i.e., Vin and Vout, along the upper bridge 210. An adjustment terminal ADJ of the power supply chip U2 is coupled to the lower bridge 212 via a resistor R32. The ADJ terminal of the power supply chip U2 is coupled to the power supply chip U2 output terminal Vout via a resistor R33. The upper bridge 210 and the lower bridge 212 are also coupled via a 0.1 $\mu$f capacitor C9.

Over-voltage protection circuitry in the form of a Zener diode D17 is also provided between the upper bridge 210 and the lower bridge 212. An indicator lamp in the form of a light-emitting diode (or "LED") D7 is provided, together with a resistor R46, between the upper bridge 210 and the lower bridge 212. The LED D7 is configured to provide visible indicia when power is supplied to the power supply 102.

The power supply 102 further comprises a lag circuit comprising a diode D4, together with a 100 k Ohm resistor R31 and capacitors C8 and C9 provided between the upper bridge 210 and the lower bridge 212. The lag circuit is configured to ensure that the switching device 10 is operating in a stable range before software in the microcontroller 106 becomes fully functional, and to avoid switching the software operation on and off with transients. Master clear signal MCLR is normally low during nonoperation of the switching device 10. As the voltage Vdd increases and goes above its oscillating point or otherwise reaches a sufficiently stable or steady-state level, MCLR goes high, which permits power to be provided to the microcontroller 106 and the software in the microcontroller 106 to operate (i.e., the microcontroller 106 is enabled). Thus, the stability and reliability of the microcontroller 106 and its operation are improved.

Diode D17 and resistor R46 also serve an over-voltage protection role. If the power supply chip U2 (LM-117) fails, diode D17 will prevent a voltage surge that could damage or destroy the microcontroller 106.

Charge switching circuit 220, such as the charge switching circuitry 104 shown in FIG. 3, may comprise a number of components used to selectively switch or control the charging or discharging of the discharge energy source 108 (shown in FIG. 4B) in response to the arm signal. The arm signal input circuitry 100 is coupled via junction 204 to the charge switching circuit 220. The charge switching circuit 220 comprises a MOS FET Q1, which is coupled at its conduction path to the arm signal input terminal 202 via junction 204. The gate of FET Q1 is coupled in parallel to junction 204 via Zener diode D1 (18 volt) and resistor R2 (30 k Ohms).

The gate of FET Q1 is also coupled via 10 k Ohm resistor R3 to a voltage divider circuit 224 and specifically to the collector of transistor Q5. The emitter of transistor Q5 is coupled to ground via parallel conduction paths. The first conduction path includes 10 k Ohm resistor R20. The second conduction path includes 5 k Ohm resistor R21, a junction 226, a 649 Ohm resistor R48, and an LED D14. The anode of LED D14 is coupled to the base of transistor Q5. The application of voltage from pin 27 of the microcontroller 106 to the base of transistor Q5 causes its conduction path to go to ground.

Turning to FIG. 4B, the microcontroller 106, in the currently preferred embodiment, comprises a programmable microcontroller. For this specific embodiment and application, the microcontroller 106 comprises a PIC16C773 microcontroller chip, commercially available from Microchip Technology, Inc. of Phoenix, Ariz. It should be noted that the present invention is not limited to the PIC16C773 chip and that any microcontroller device presently known in the art is within the scope of this invention. The microcontroller 106 may be a 28- or 29-pin device; the specific functioning of each such pin is described in information publicly available from Microchip Technology, Inc.

In the illustrated embodiment, pin 1 of the microcontroller 106 is coupled to the master clear MCLR signal of power supply 102, as shown in FIG. 4A. The microcontroller 106 is designated in FIG. 4B as chip U3. Pin 4 of the microcontroller 106 is coupled to the arm signal input terminal 202 via junctions 204, 206, 100 k Ohm resistor R25 and a high frequency noise filter comprising 10 k Ohm resistor R26 and 0.01 $\mu$f capacitor C6 coupled in parallel to ground. Pin 7 of the microcontroller 106 is coupled to the supply voltage Vdd. Pin 7 is also coupled via 5 k Ohm resistor R51 to pin 9. Pin 7 is coupled to ground in series with resistor R51 and 22 picofarad ("pf") capacitor C5. Pin 9 is coupled to the supply voltage Vdd via resistor R51 and to ground via capacitor C5. Pins 8 and 19 of the microcontroller 106 are coupled to ground. Pin 27 of the microcontroller 106 is coupled to the voltage divider circuit 224 at junction 226, as shown in FIG. 4A.

Although the microcontroller 106 comes with its own clocking circuitry, in the currently preferred embodiment and method, a clock or oscillator is provided using pins 7 and 9 of the microcontroller 106 with 5 k Ohm resistor R51 and a 22 pf capacitor C5. This produces a clock rate of approximately 4 megahertz ("MHz").

The discharge energy source 108 is coupled to the drain of FET Q1 of charge switching circuit 220 via 100 Ohm resistor R4. A voltage divider 260 is coupled to resistor R4 via 90 k Ohm resistor R5. The voltage divider 260 comprises a 0.01 $\mu$f capacitor C1 and a 10 k Ohm resistor R6 in parallel to ground. The voltage divider 260 is also coupled to pin 2 of the microcontroller 106. A principal component of discharge energy source 108 in this illustrative embodiment comprises a discharge capacitor C2. The discharge capacitor or capacitive device C2 is the principal source of energy to be discharged into the detonation device 119, also referred to herein as "SCB 119," (shown in FIG. 4C) to cause the detonation. In the currently preferred embodiment described herein, the capacitive device C2 comprises a bank of three discharge capacitors (not shown). An 81 k Ohm resistor R7, capacitive device C2, and a 47 volt Zener diode D8 are coupled in parallel from rail 270 to ground at rail 272. The conduction path of a transistor Q3 is also coupled between the rails 270 and 272 via a 100 Ohm series resistor R9. The base of transistor Q3 is coupled to the rail 272 and therefore to ground via a 10 k Ohm resistor R55. The base of transistor Q3 is also coupled via a 5 k Ohm resistor R18 to pin 22 of the microcontroller 106.

Returning to FIG. 4A, a fire signal input 110 includes a fire signal input terminal 300 coupled across a ground terminal 302. An upper rail 304 extends from the fire signal input terminal 300, and a lower rail 306 is coupled to ground at terminal 302.

Blocking circuit 112 comprises a diode D9 coupled to fire signal input terminal 300 at its anode along upper rail 304 (junction 310). A 47 volt Zener diode D16 is coupled to the cathode of diode D9 and to ground at lower rail 306 (junction 312). A 100 Ohm resistor R37 is coupled to the cathodes of diodes D9 and D16 at junction 310. A 9 volt diode D12 is positioned in lower rail 306 and is coupled at its anode to the anode of diode D16. The cathode of diode D12 is coupled to resistor R37 at upper rail 304 via a 10 k Ohm resistor R39 (junction 314). Junction 316, to which the cathode of diode D12 and resistor R39 are coupled, is also coupled to a 10 k Ohm resistor R42 disposed in lower rail 306. A diode D10 is coupled across rails 304 and 306 at junctions 318 and 320, respectively, so that the cathode of the diode is coupled to junction 318 on upper rail 304. An 820 pf capacitor C10 is also coupled across rails 304 and 306. A PNP transistor Q9 is disposed such that its emitter is coupled to terminal 322 and its base is coupled to junction 324.

Blocking circuit 112 is coupled at the collector of transistor Q9, and via 10 k Ohm resistor R50, to a voltage-dividing circuit 350. The voltage-dividing circuit 350 comprises a 5 k Ohm resistor R47, 0.01 $\mu$l capacitor C7, and 5 volt Zener diode D13, each coupled in parallel between resistor R50 and ground. This circuit functions as a high pass filter, wherein diode D13 serves as a clamping diode. If resistor R47 fails, diode D13 clamps the voltage so the microcontroller 106 is not adversely affected. The output of blocking circuit transistor Q9 (at its collector) comprises a line 360 which serves as an input, via diode D19, to pin 21 of the microcontroller 106. The signal on line 360 can serve as an interrupt to pin 21 of the microcontroller 106, as will be explained in greater detail below. Line 360 is also coupled to pin 5 of the microcontroller 106, which permits bandwidth and voltage level testing to be done on the fire signal to verify that they are within desired ranges.

Returning to FIG. 4B, the fire signal verification circuit 114 in a preferred embodiment comprises a voltage divider circuit. The fire signal verification circuit 114 comprises transistors Q4 and Q8. The base of transistor Q4 is coupled via a 5 k Ohm resistor R10 to pin 26 of the microcontroller 106 and to ground via a 10 k Ohm resistor R11. The base of transistor Q8 is coupled to line 360 from the blocking circuit 112 and the voltage-dividing circuit 350 via a 30 k Ohm resistor R35. The base of transistor Q8 is also coupled to ground via 10 k Ohm resistor R30. The emitter of transistor Q4 is coupled to the collector of transistor Q8, and the emitter of transistor Q8 is coupled to ground. The collector of transistor Q4 is coupled to the high-side fire circuit 116 via 10 k Ohm resistor R13, as will now be explained.

Figure 4C:
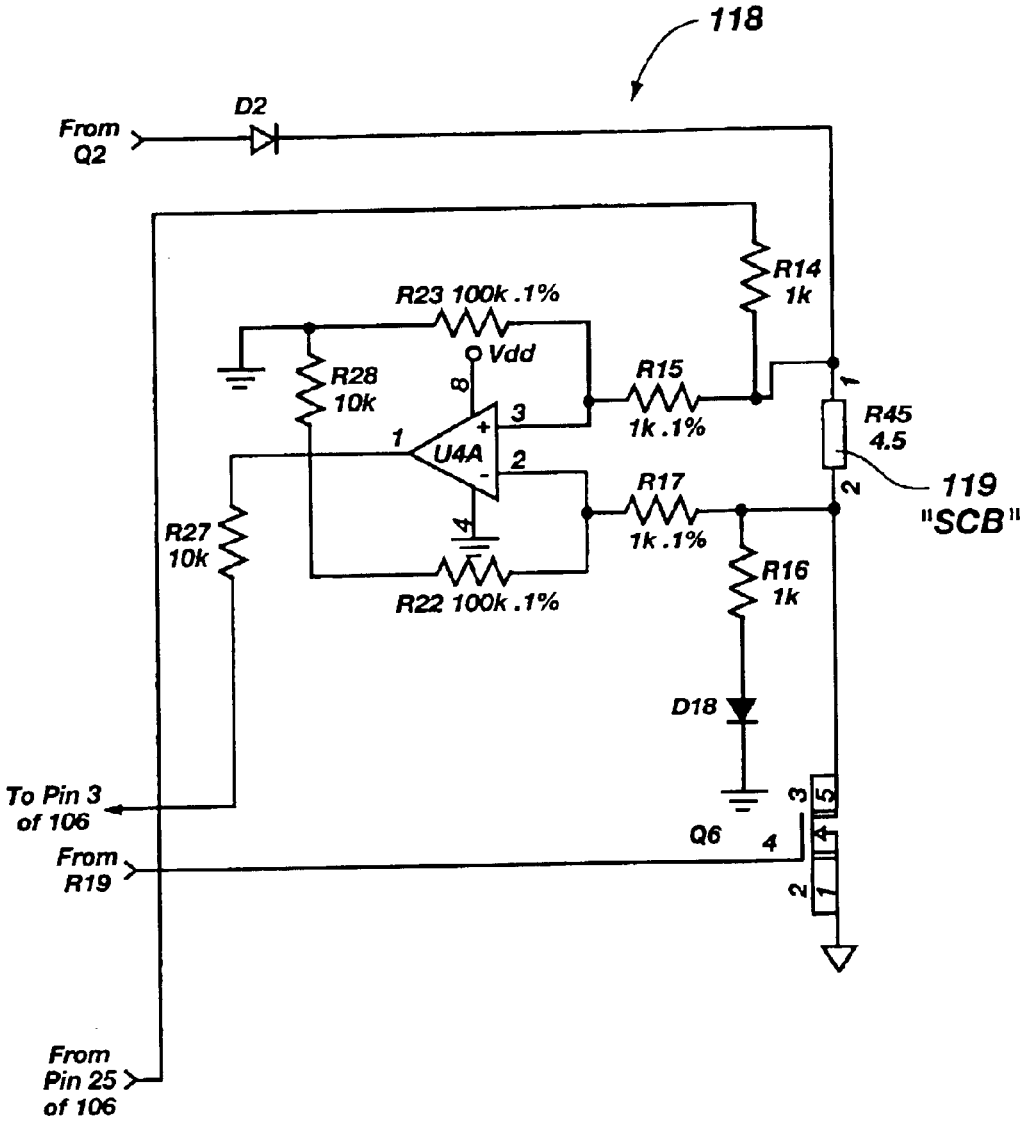

The high-side fire circuit 116 comprises a P-channel MOS FET switch Q2, which serves as the principal switching device for switching the electrical energy stored in discharge capacitor bank C2 to the detonation device 119 shown in FIG. 4C. The source of FET Q2 is coupled to the discharge capacitor bank C2 via rail 270. The source of FET Q2 is also coupled in parallel to resistor R13 via an 18 volt Zener diode D3 and a 30 k Ohm resistor R12. The gate of FET Q2 is coupled to resistor R13 and to the source of FET Q2 via the parallel circuit comprising diode D3 and resistor R12, respectively. The drain of FET Q2 is coupled to the anode of diode D2.

The fire signal verification circuit 114 also comprises a transistor Q7 for shunting the output of the high-side fire circuit 116 to ground in the event that conditions or constraints placed on the fire signal input are not met. More specifically, transistor Q7 is coupled to the output or drain or FET Q2 of the high-side fire circuit 116. The emitter of transistor Q7 is coupled to ground. The base of transistor Q7 is coupled to a "pull up" voltage supply Vdd via 10 k Ohm resistor R24, and to pin 6 of microcontroller 106. Transistor Q7 is normally in the "on" state. Transistor Q7 is also referred to herein as the "low-side fire switch."

Turning now to FIG. 4C, the SCB monitoring circuit 118 is used to monitor any voltages that may exist across the SCB 119, and to affect system processing if a voltage difference above a threshold level is detected. The SCB monitoring circuit 118 is used in the preferred embodiment to make measurements on a very small voltage drop across the SCB 119, because large resistors are being used as current limiters.

The SCB monitoring circuit 118 comprises an operational amplifier ("op amp") U4A, one terminal of which is supplied with voltage Vdd and one terminal of which is coupled to ground. Terminal 1 of the op amp U4A is coupled via a 10 k Ohm resistor R27 to pin 3 of the microcontroller 106. Terminal 1 of the op amp U4A is also coupled to ground via a 10 k Ohm resistor R28. In addition, terminal 1 of the op am U4A is coupled to terminal 3 (+) via a 100 k Ohm resistor R23 and to terminal 2 (–) via a 100 k Ohm resistor R22. Terminal 3 of the op amp U4A is coupled via a 1 k Ohm resistor R15 and a 1 k Ohm resistor R14 to pin 25 of the microcontroller 106. Terminal 2 of op amp U4A is coupled via a 1 k Ohm resistor R17, a 1 k Ohm resistor R16, and a diode D18 to ground. Terminal 2 of op amp U4A is coupled to the lower terminal of the detonation device 119 via resistor R17, and terminal 3 is coupled to the upper terminal of the detonation device 119 via resistor R15. Thus, terminal 3 is coupled via resistor R15 to the output of FET Q2 of high-side fire circuit 116 via diode D2.

An N-channel MOS FET Q6 is also provided such that its source is coupled to the lower terminal of the detonation device 119 and its drain is coupled to ground. FET Q6 is normally on. The gate of FET Q6 is coupled to the collector of transistor Q7 and, via resistor R19, to the drain of FET Q2 of high-side fire circuit 116.

The detonator monitoring circuit 118 provides a differential measurement technique for monitoring the status of the detonation device 119, here the SCB, in a safe manner. Energy is taken out of the microcontroller 106 as a voltage source, is current limited on the output, sent through the SCB 119, and then current limited back to ground. The voltage differential across the SCB 119 is thus measured, which provides a high resolution measurement, e.g., suitable in an ordnance environment.

The output of detonator monitoring circuit 118 is an input to pin 3 of the microcontroller 106, where the microcontroller 106 performs a digital-to-analog ("D/A") conversion and compares this measured value with a threshold value.

Returning again to FIG. 4A, status output circuit 120 comprises circuitry to enable the switching device 10 to provide status information so that the system conditions, performance, etc. can be monitored. As implemented in the preferred embodiment, this circuitry comprises a status line 380 emanating from pin 4 RC3/SCK/SCL of the microcontroller 106 and a telemetry line 390 emanating from pin 28 of the microcontroller 106. Status line 380 is outputted at a status output terminal 382. A 1 k Ohm resistor R29 and a diode D5 are in series with respect to pin 4 RC3/SCK/SCL of the microcontroller 106 and status output terminal 382. Status line 380 is coupled to ground via a 10 k Ohm resistor R52 between status output terminal 382 and diode D5. The telemetry terminal 392 is coupled to pin 28 of the microcontroller 106 via a 1 k Ohm resistor R34 and diode D6. Telemetry line 390 is coupled to ground between telemetry terminal 392 and diode D6 by a 10 k Ohm resistor R36.

Figure 7:
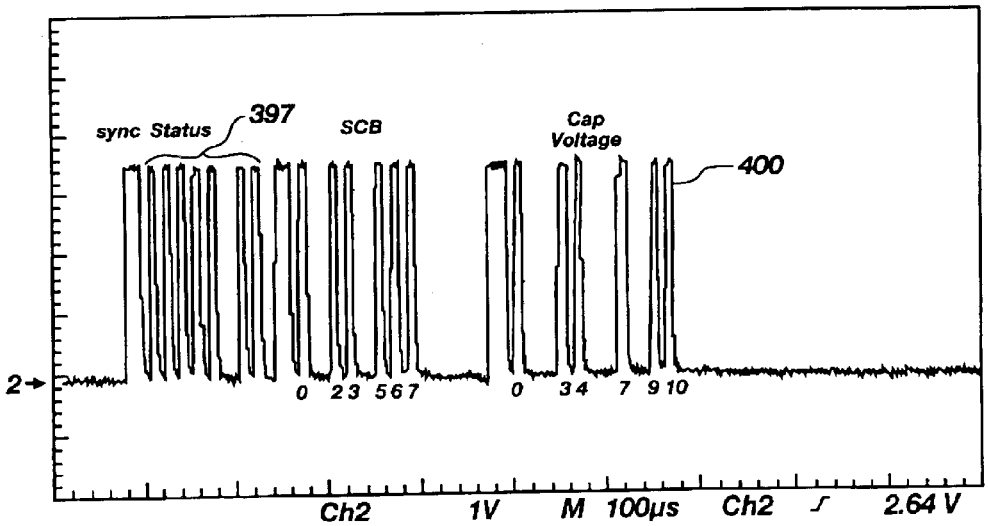
FIG. 7 is an illustrative status output for the electronic switching device shown in FIG. 1.

FIG. 7 shows the first eight bits 397, or output, at the status output terminal 382. The bytes thereafter are similarly configured. FIG. 7 illustrates a digital signal 400 showing the values of the signals for the components indicated (e.g., status, SCB, cap voltage). The top of the chart shows how the values were calculated. FIG. 7 shows outputted measurements for the SCB 119 and for capacitor voltage for the high-side fire circuit 116. According to one embodiment of the present invention, these measured values are reported approximately once every 400 microseconds.

Figure 6:
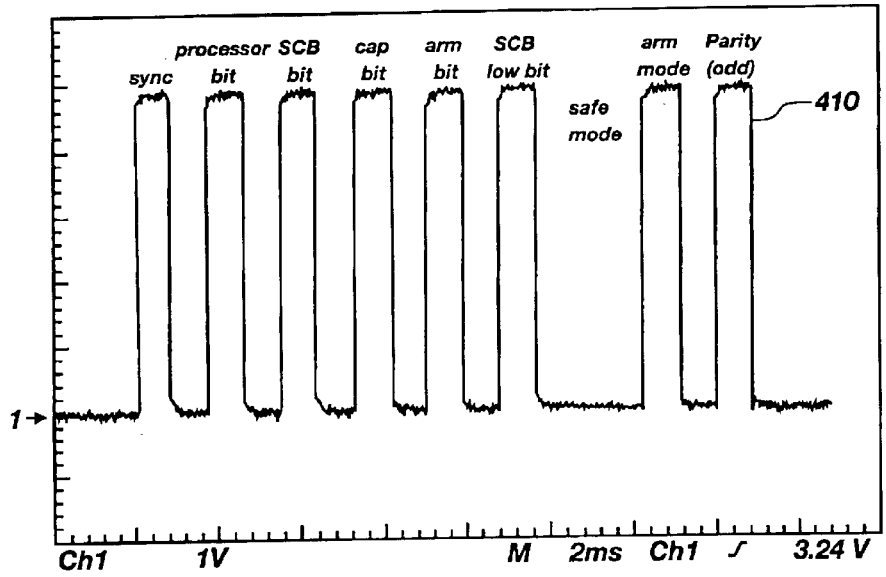
FIG. 6 is a sample telemetry output for the electronic switching device shown in FIG. 1.

FIG. 6 shows the first eight bits of data of the telemetry output 410 at telemetry terminal 392. The bytes thereafter are similarly configured. According to one embodiment of the present invention, the telemetry output 410 is generated approximately every 15 millisecond.

Figure 5:
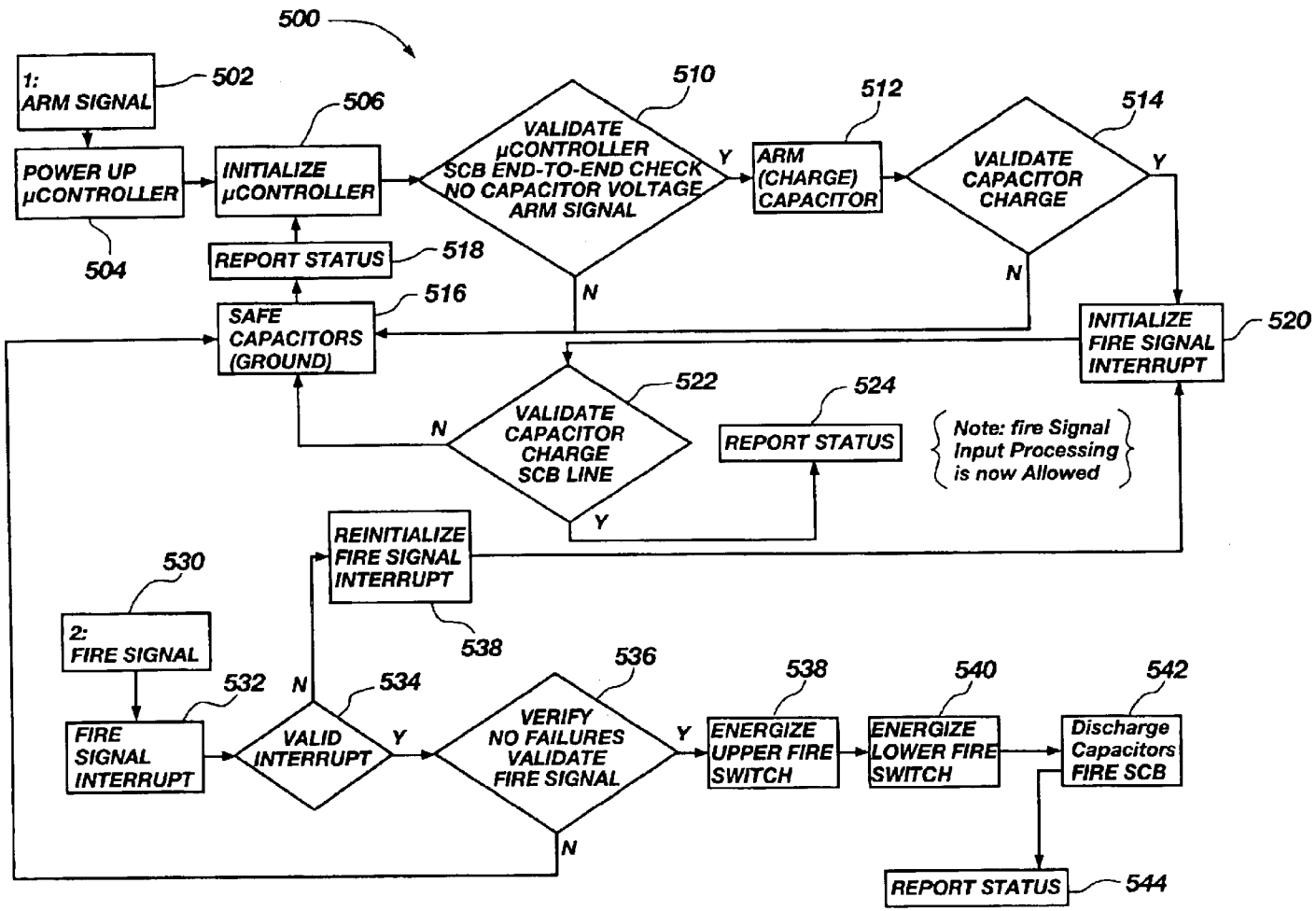
FIG. 5 is a flow diagram of a method, according to one aspect of the present invention, as implemented in the electronic switching device shown in FIG. 1.

Referring to FIG. 5, in accordance with another aspect of the invention, a method 500 is provided for electronically switching a detonation device. The currently preferred implementation of the method 500 will be described and illustrated using the switching device 10 described above in FIGS. 3 through 4C. It should be understood, however, that the method 500 is not so limited, nor is the method 500 according to this aspect of the invention necessarily limited to the specific exemplary implementation described herein.

FIGS. 3 through 5, prior to receiving an ARM signal at arm signal input terminal 202, the switching device 10 is in a quiescent state. The power supply 102 is not providing power to the system, the capacitors and capacitive devices have been bled of charge, and the microcontroller 106 is in an "off" and unpowered state.

The method 500 shown in FIG. 5 in general terms, comprises arming a discharge energy source that will provide discharge energy to a detonation device. In this implementation, this comprises applying a steady-state voltage to the arm signal input terminal 202 as shown at block 502. The function of the power supply 102 has been described above.

After power up has been completed as shown at block 504, the switching device 10 begins to conduct startup system checks. Block 506, for example, shows initialization of the microcontroller 106, which may include the startup system checks. Thus, the startup system checks may include self testing and built-in testing of the microcontroller 106. Some of the tests are provided as part of the microcontroller 106 by the manufacturer. Others are specific to the system, as generally described herein. The built-in tests are used in part to verify operational integrity for this application.

The SCB 119 is also checked to verify that there are no voltages across the SCB 119, or that its voltages are in a valid range. Measurements are made of the specific voltage differences to compare them with thresholds. The system also checks to confirm that there are no voltages on the discharge capacitors C2. A check is also made to verify that the arm signal is proper. The voltage and bandwidth of the arm signal are checked to verify validity, as was discussed above.

Once these checks are complete as shown at block 510, the charge capacitors C2 are charged, or armed, as shown at block 512, and the system and method go into an idle or wait mode to await the fire command. If there is a valid charge on the charge capacitors C2 as shown at block 514, then a fire signal interrupt is initialized at block 520. In the interim, background monitoring continues to be run. This includes monitoring the discharge capacitors C2, checks to confirm that there are no voltages on the SCB 119 above a set point, etc., as shown at block 522. If there is a failure, the discharge capacitors C2 are shunted and a "safe" condition is implemented, as shown at block 516.

The "fire" condition, instructing the SCB 119 to be fired, is initiated by the fire input signal at block 530, which is inputted at fire signal input terminal 300.

The fire signal is the voltage differential across terminals 300 and 302 and to blocking circuit 112. If the fire signal exceeds a threshold value, it is applied to transistor Q9. This continues until the voltage exceeds the value of Zener diode D12. When that happens, current passes through diode D12 and the voltage drops, which in turn allows transistor Q9 to turn on. Voltage dividing circuit 350 divides this energy, and the signal passes on line 360 to pins 5 and 21 of the microcontroller 106, and to the gate of transistor Q8. Pin 21 of the microcontroller 106 is an interrupt, as shown at block 532. The microcontroller 106 queries whether there is a valid interrupt at block 534. If there is not a valid interrupt, the fire signal interrupt is reinitialized at block 538. If there is a valid interrupt, the signal on pin 5 of the microcontroller 106 is analyzed for voltage level and bandwidth. Pin 5 of the microcontroller 106 is an analog port. If the voltage level and bandwidth meet or exceed threshold levels and are deemed valid at block 536, the output at pin 26 of the microcontroller 106 goes high. This applies a voltage to transistor Q4 which causes the high-side firing circuit FET Q2 to be turned on and become conductive, as shown at block 539.

When FET Q2 is turned on, it provides a voltage via diode D2 to the upper terminal of the SCB. The output of FET Q2 also is applied to the gate of FET Q6, which is coupled to the lower terminal of the SCB, thus causing it to turn on. This means that the high-side firing circuit provides a signal and energy to FET Q6 to allow it to turn on. If FET Q2 is not activated, low side FET Q6 cannot be activated. This provides improved reliability and safety. Even if microcontroller 106 malfunctions, for example, the switching device 10 cannot activate to fire if these two FETs (i.e., Q2 and Q6) required for firing are not activated together.

Once the signal is applied to the gate of FET Q6, it begins to charge FET Q6. This charging requires and affects a certain time delay. That time delay causes a delay in the activation of the SCB 119 and causes the SCB 119 to activate strongly when the path through it finally is activated. Thus, the intrinsic or internal capacitance of the gate of FET Q6 is used as a delay circuit to properly time and activate the SCB 119. The microcontroller 106 sends a high-side fire signal to high-side fire circuit 116, which causes it to open FET Q2 and thereby discharge capacitor bank C2 to the high terminal of SCB 119, as discussed above. The microcontroller 106 also sends a low-side fire signal to low-side fire switch Q7, as shown at block 540. Thus, the capacitors C2 discharge at block 542 and fire or activate the SCB 119.

FIG. 5 also shows reporting the status of the switching device 10 at blocks 518, 524 and 544. Reporting the status of the switching device 10 was discussed above in relation to FIGS. 6 and 7.

Figure 8:
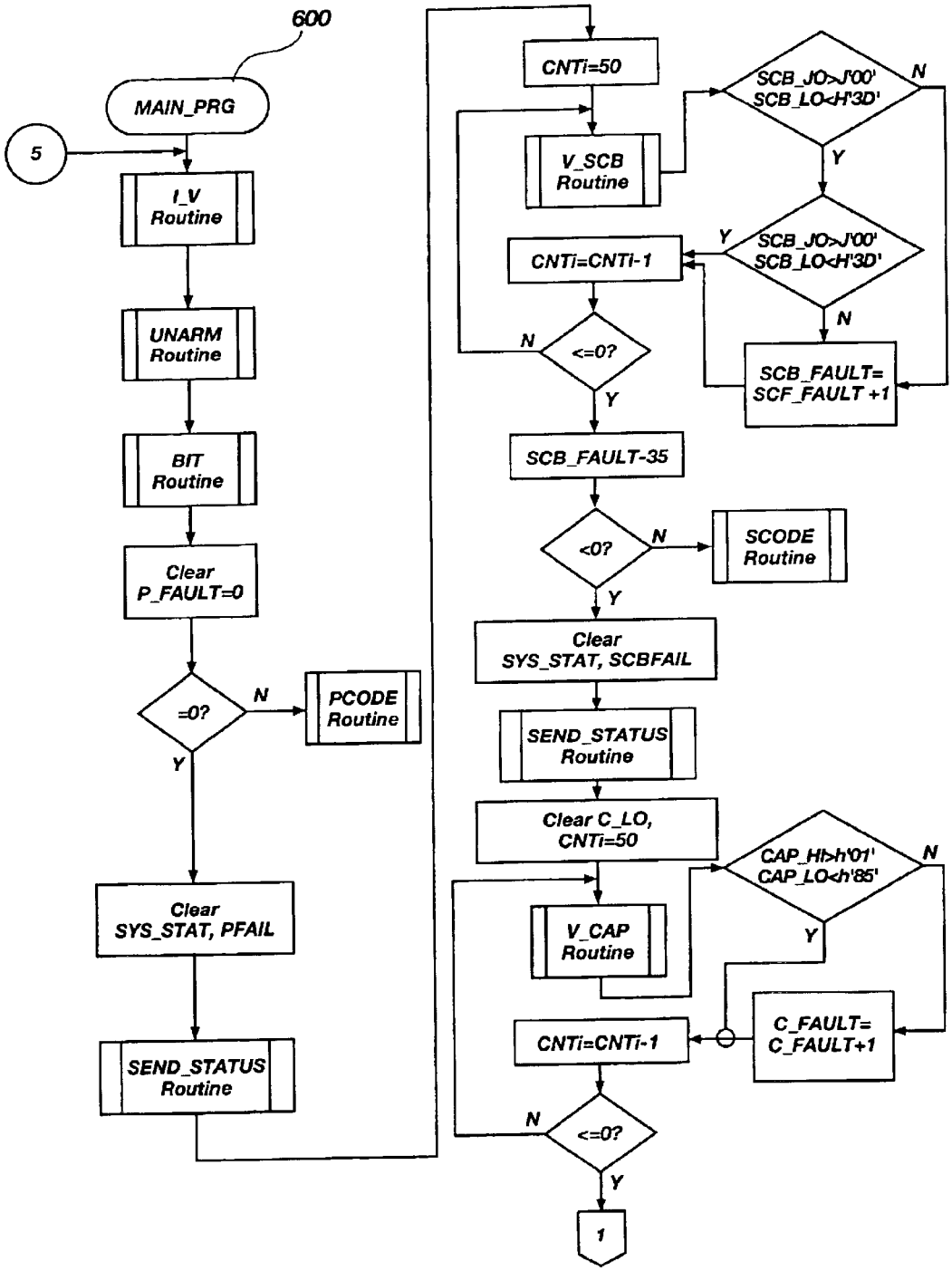
FIG. 8 is a processing flow of a main program used in the microcontroller of the electronic switching device shown in FIG. 1, according to one embodiment of the present invention.
Figure 9:
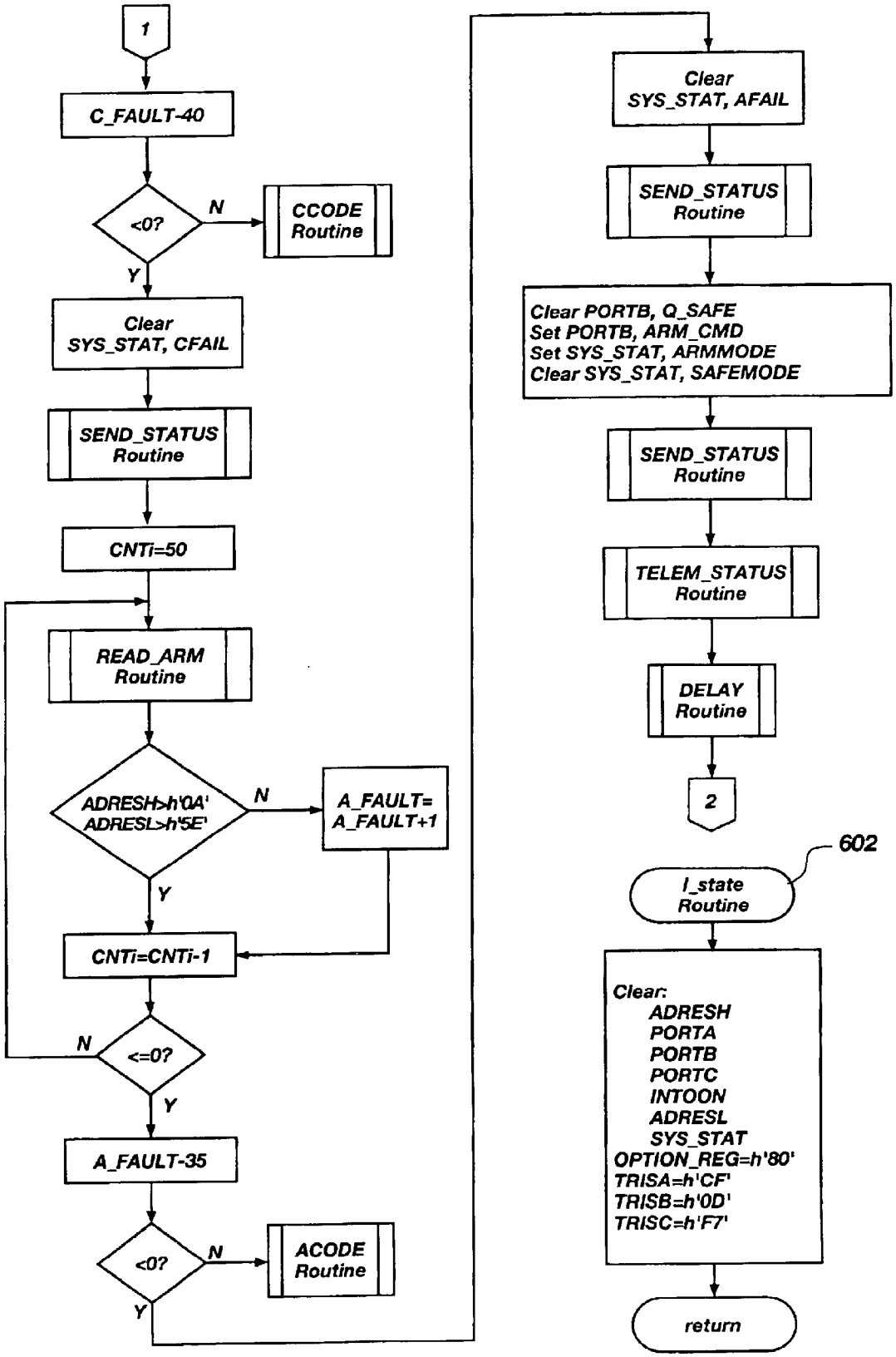
FIG. 9 shows additional processing flows, continued from those of FIG. 8, and an "I_state" routine associated with the microcontroller of the electronic switching device shown in FIG. 1.
Figure 10:
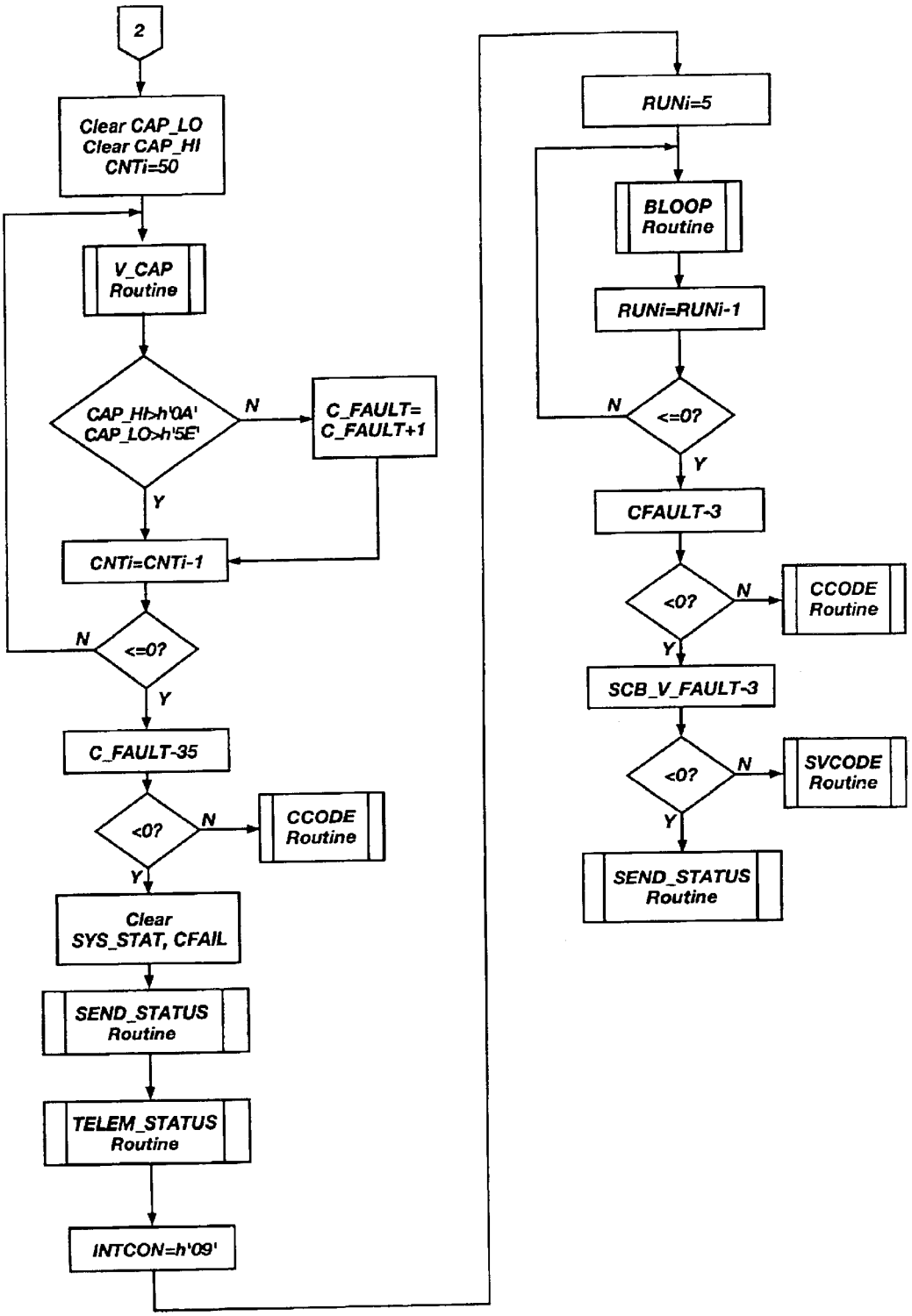
FIG. 10 shows additional processing flows, continued from FIG. 9, for the microcontroller of the electronic switching device shown in FIG. 1.

FIGS. 8 through 10 illustrate the processing flows associated with a main program 600 configured for use with the microcontroller 106 shown in FIG. 4B. The main program 600 performs the sequential operations shown in these flows, including calling of the various routines and subroutines identified in the blocks in FIGS. 8 through 11. The block at FIG. 8 labeled "1" indicates that processing continues at the same block at the top left portion of FIG. 9. This type of notation is used throughout the processing flows to show continuation of processing flow, as is well known in the art. In addition to showing a continuation of the processing flows of the main program 600 shown in FIG. 8, FIG. 9 also illustrates process flows for "I_State Routine" 602 in which variable registers are cleared and initialized.

Figure 11:
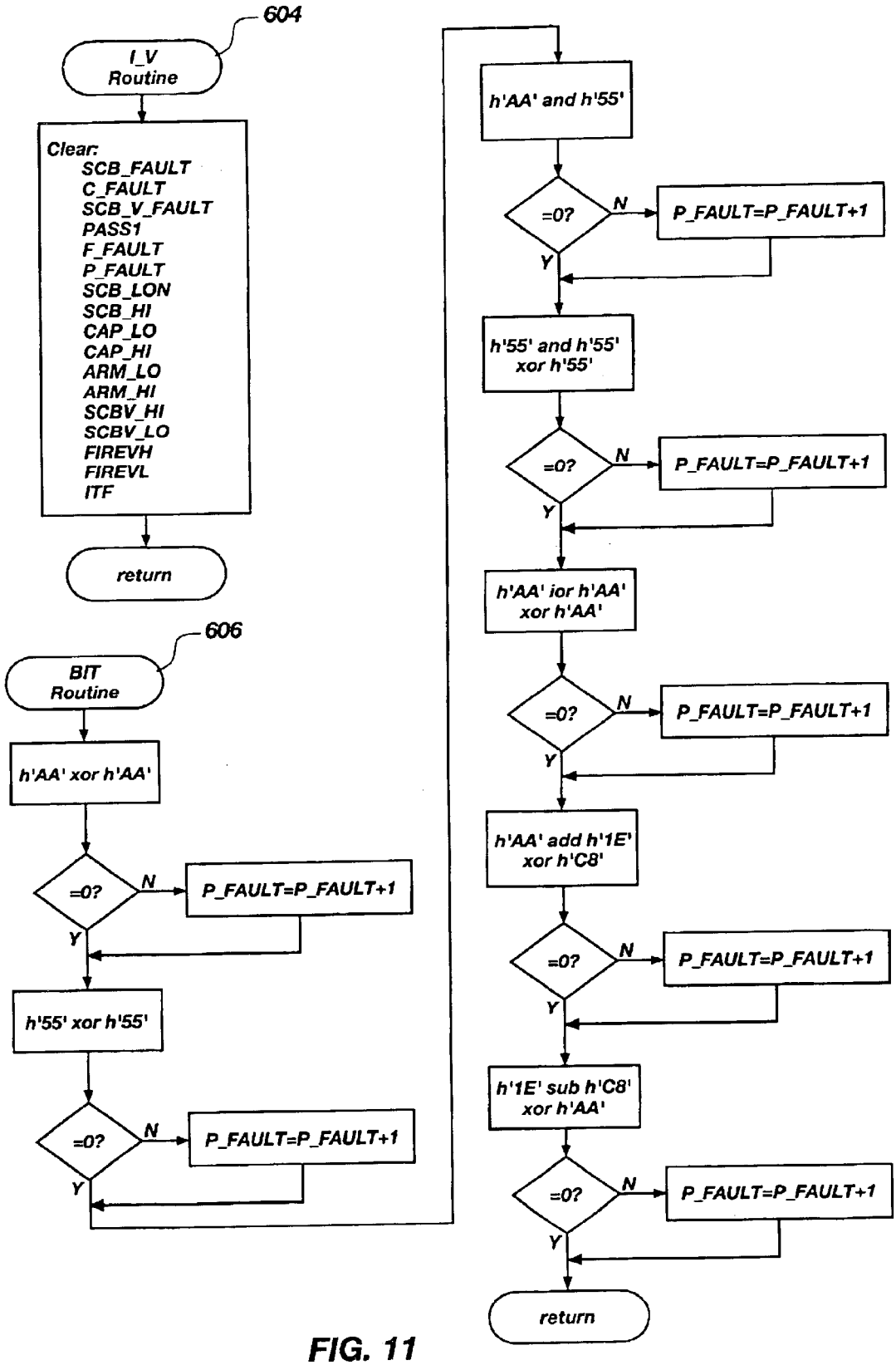
FIGS. 11 through 32 are processing flows for routines and subroutines associated with the microcontroller of the electronic switching device of FIG. 1.

FIG. 11 shows processing flows for "I_V Routine" 604 in which variable registers are cleared and initialized. The microcontroller 106 is manufactured to include certain test procedures. In addition to these, the flows in FIG. 11 identified as "BIT Routine" 606 are tests that are specifically performed in the preferred embodiment to verify the integrity of the microcontroller 106 and its ability to perform functions as required in the switching device 10. As can be readily ascertained from FIG. 11, various registers are loaded, incremented, etc. to verify the basic functionality of the microcontroller 106.

Figure 12:
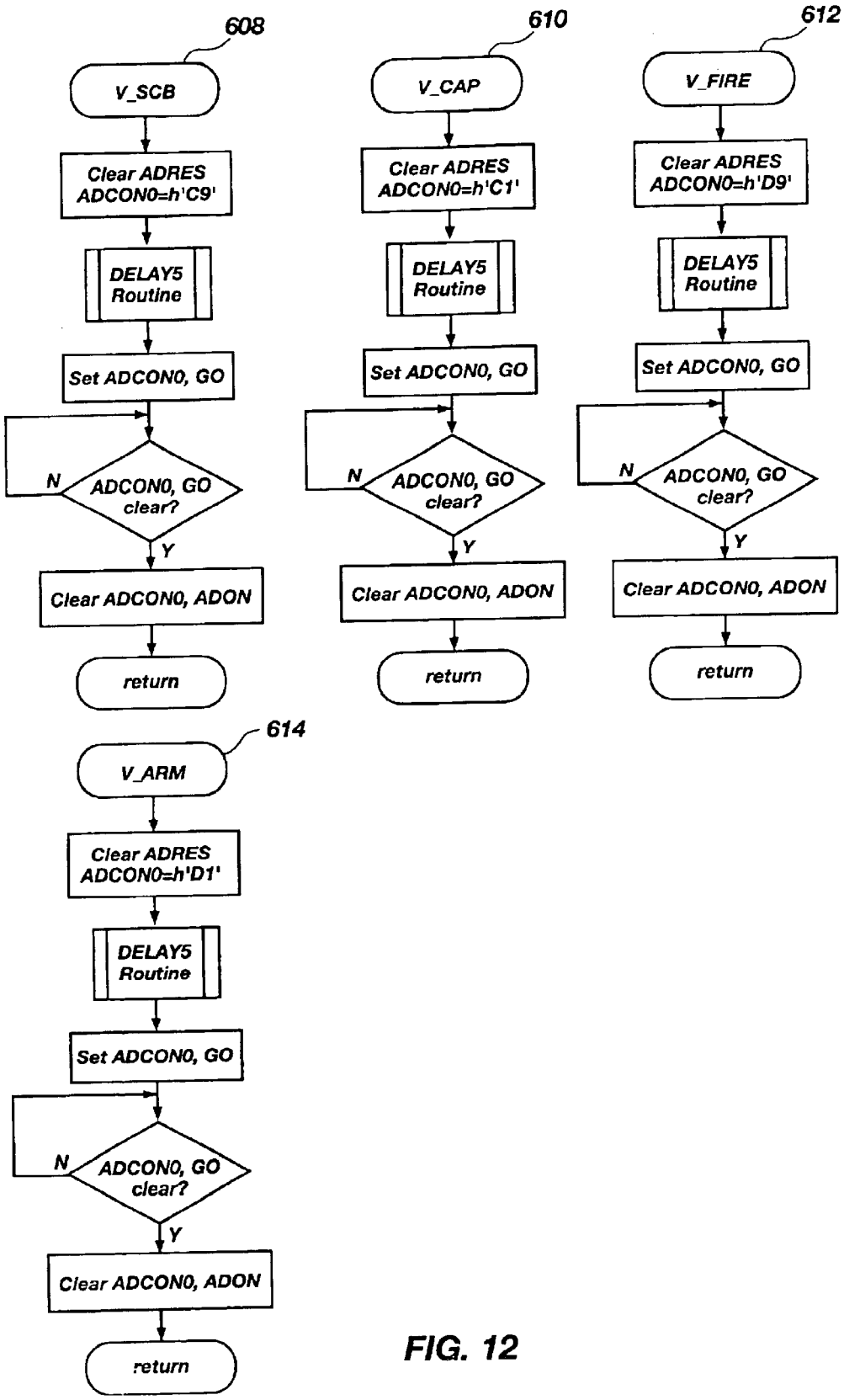

FIG. 12 shows the various process flows used to check or measure voltage levels and verify their validity relative to the referenced voltages in the microcontroller. These include voltage checks or measurements on the SCB 119 (V_SCB 608), the voltage on the capacitors C2 (V_CAP 610), the voltage associated with the fire signal (V_FIRE 612), and that associated with the arming signal (V_ARM 614).

Figure 13:
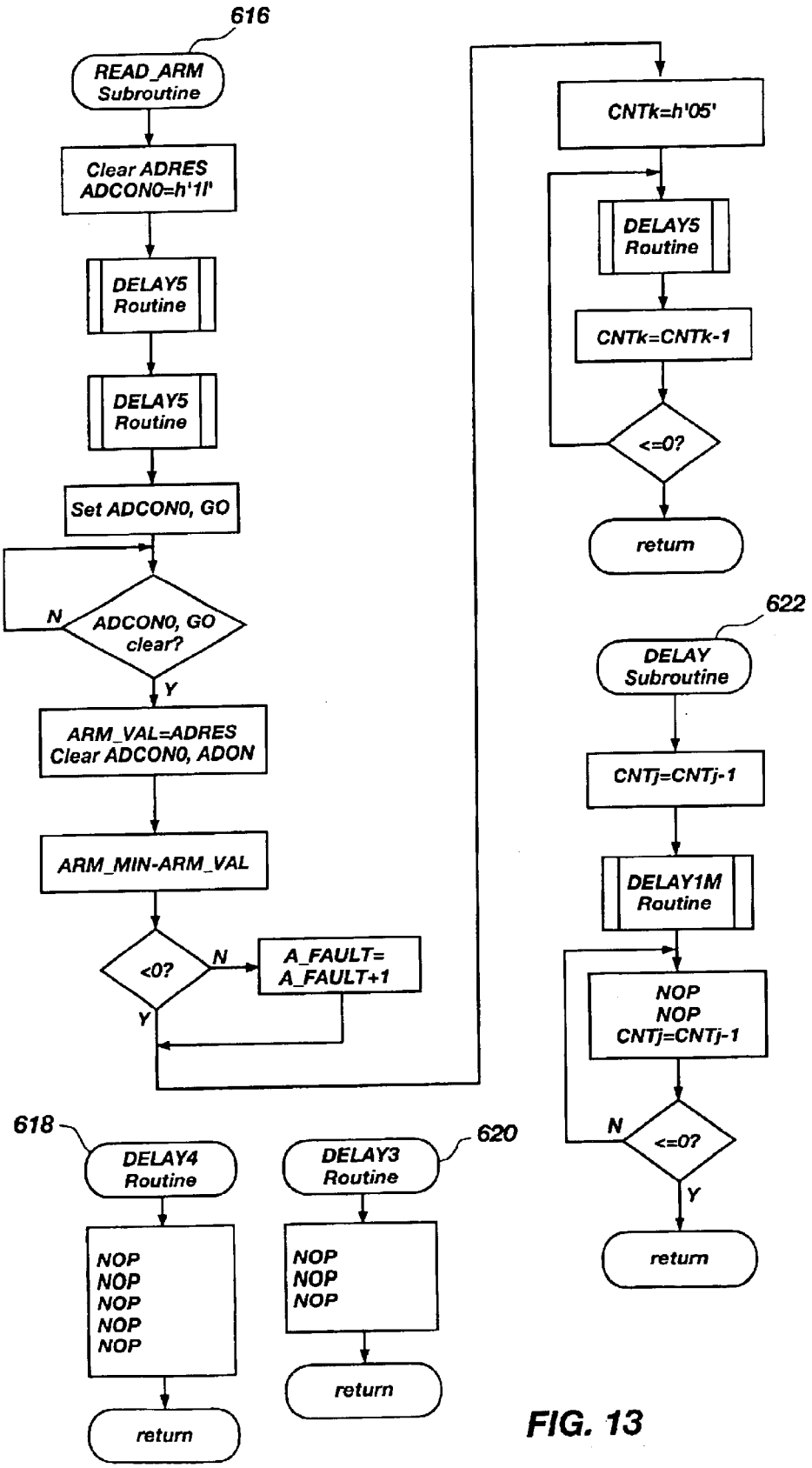

FIG. 13 provides processing flows associated with reading and validating the arm signal. In the "READ_ARM Subroutine" 616, the arm signal value is compared to a minimum or threshold arming signal level. Various delays 618, 620, 622 are provided, depending on the duration needed for the processing flow. Delays 618, 620, 622 are used, for example, to obtain or hold a voltage level for status output. Delays 618, 620, 622 may be effected by providing a single instruction (e.g., NOP) that causes a predetermined delay. For example, the "DELAY3 Subroutine" 620 would involve a 3 microsecond delay.

Figure 14:
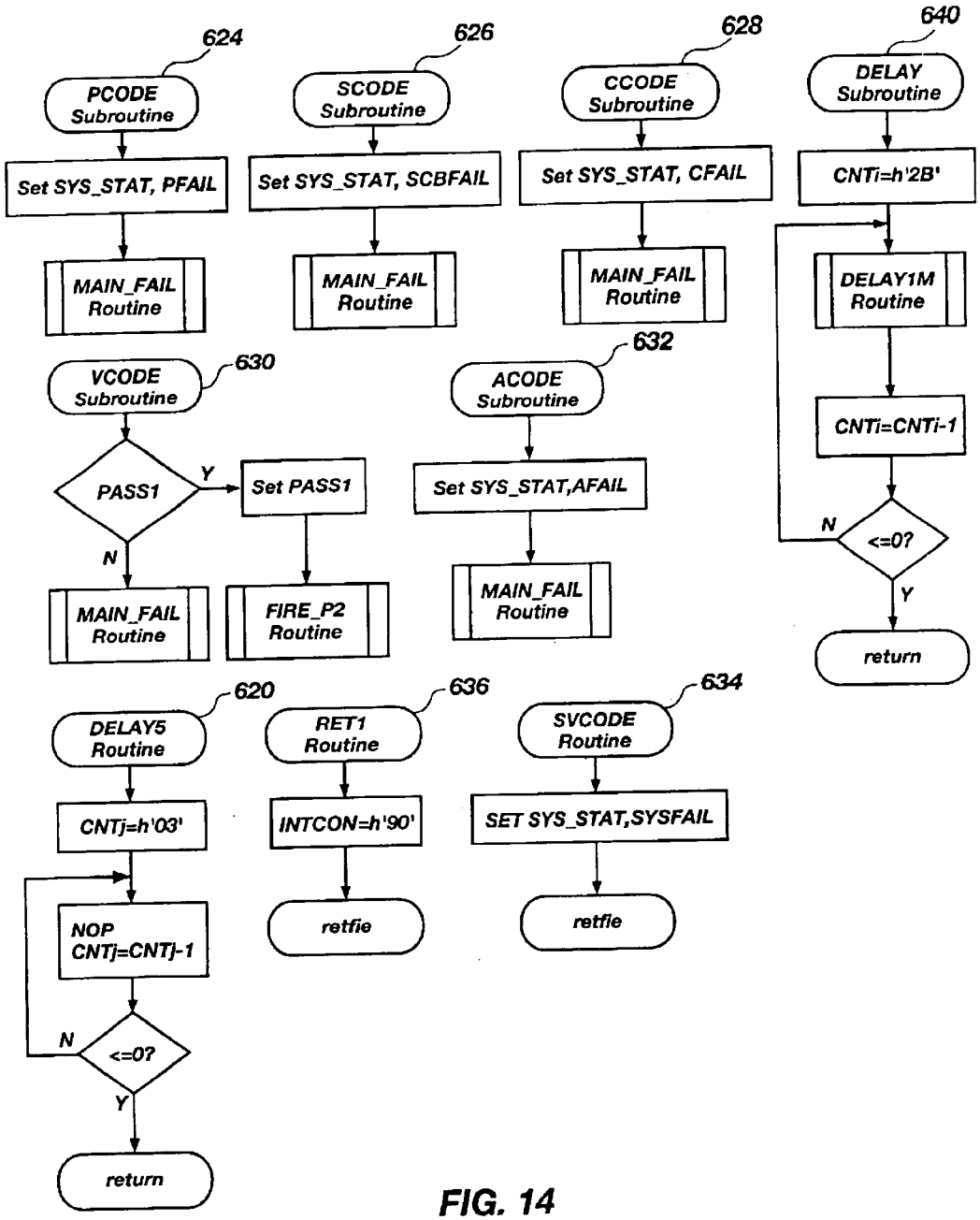

FIG. 14 shows processing flows associated with setting bits in statistics registers to report status or failures. These include bits for the microcontroller 106 (PCODE 624) for the SCB 119 (SCODE 626), for the capacitors C2 (CCODE 628), for the voltage on the fire signal (VCODE 630) and on the arming signal (ACODE 632). A system failure check (SVCODE 634) also is included. In the event of a failure, the microcontroller 106 bleeds the capacitor C2 and shuts down or reboots. The "RETI Routine" 636 resets interrupts after a failure has occurred during fire. In each event, in accordance with the currently preferred embodiment and method, two attempts are made to validate and set bits in the statistics register. Upon the second failure, the system is shut down. FIG. 14 also shows process flows for 37 DELAY5 Routine" 638 and "DELAY Subroutine" 640, which provide delay as discussed above in relation to FIG. 13.

Figure 15:
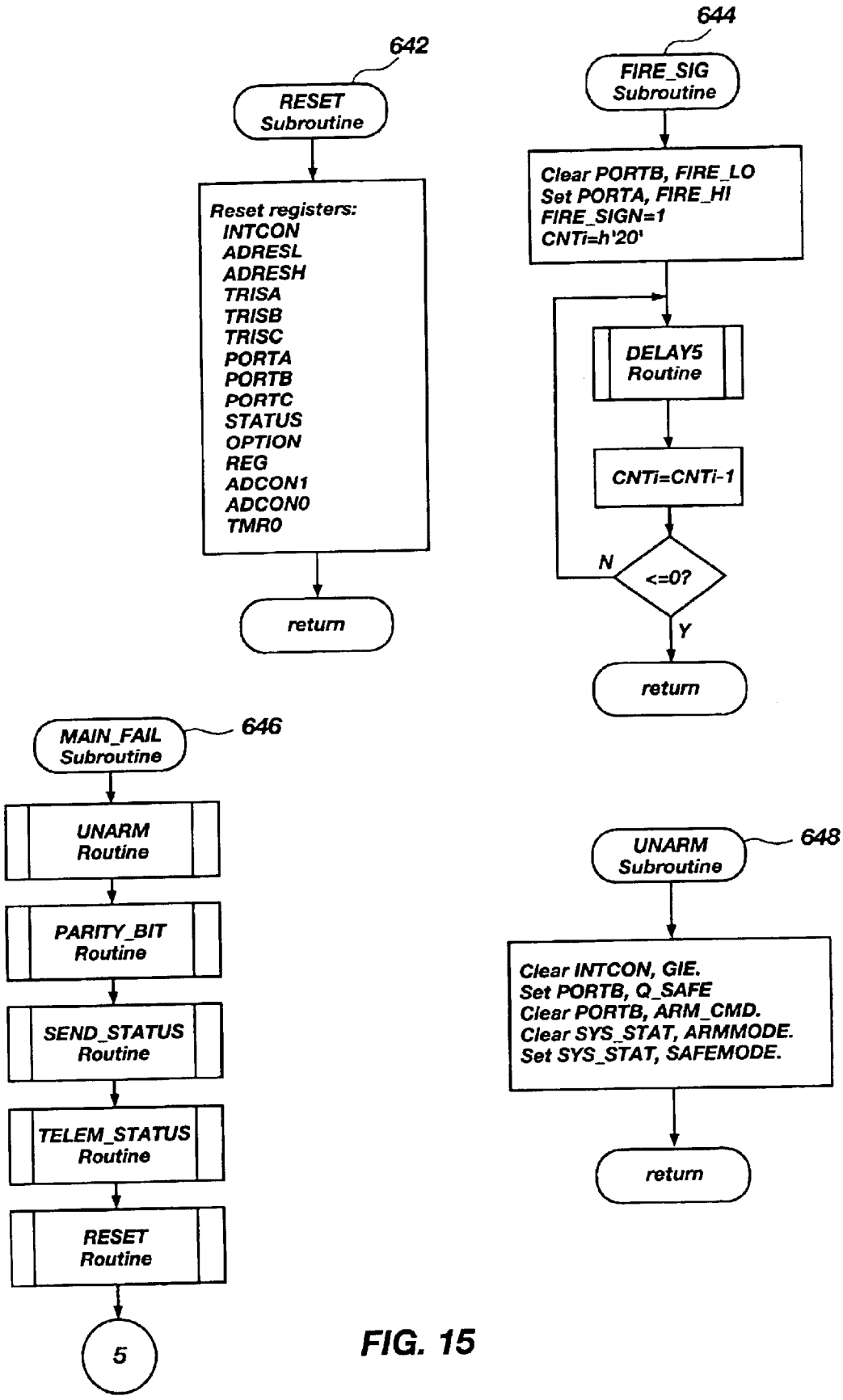

FIG. 15 shows processing flows associated with the "RESET Subroutine" 642, the fire signal or "FIRE_SIG Subroutine" 644, the main failure or "MAIN_FAIL Subroutine" 646, and the "UNARM Subroutine" 648. The RESET subroutine 642 lists a number of variables associated with the microcontroller 106 by the manufacturer. The fire signal subroutine 644 processes portions of the microcontroller 106 associated with fire signals. It should be noted that the set and clear functions in the fire signal subroutine 644 may be processed in reverse order, e.g., so that the set function is performed before the clear function. The main failure subroutine 646 disarms the switching device 10, places the capacitors C2 in safe mode, checks that the device indeed has failed, and provides telemetry status. The circle at the bottom of that subroutine flow indicates that processing is returned back to the corresponding circle in FIG. 8.

Figure 16:
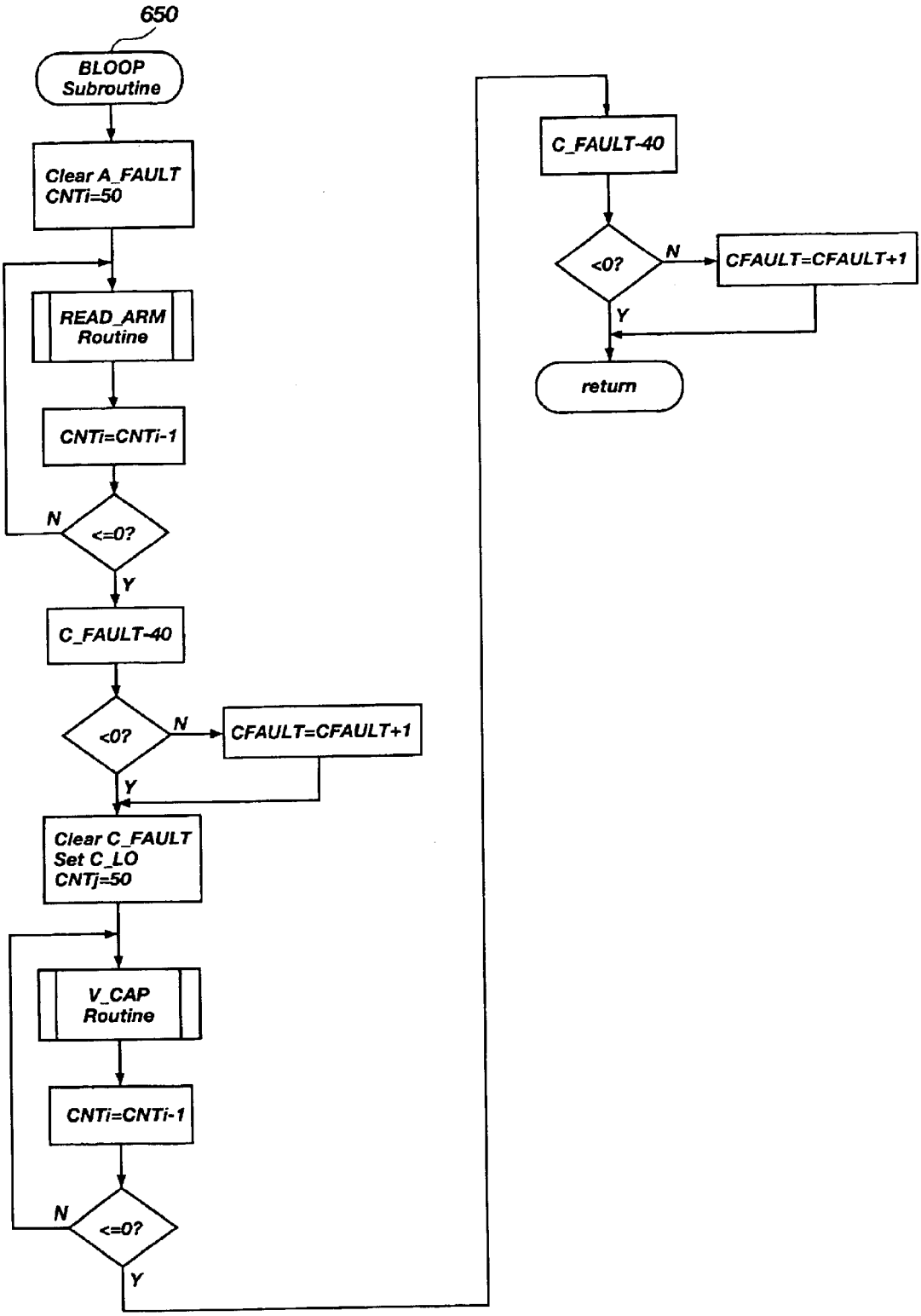
Figure 17:
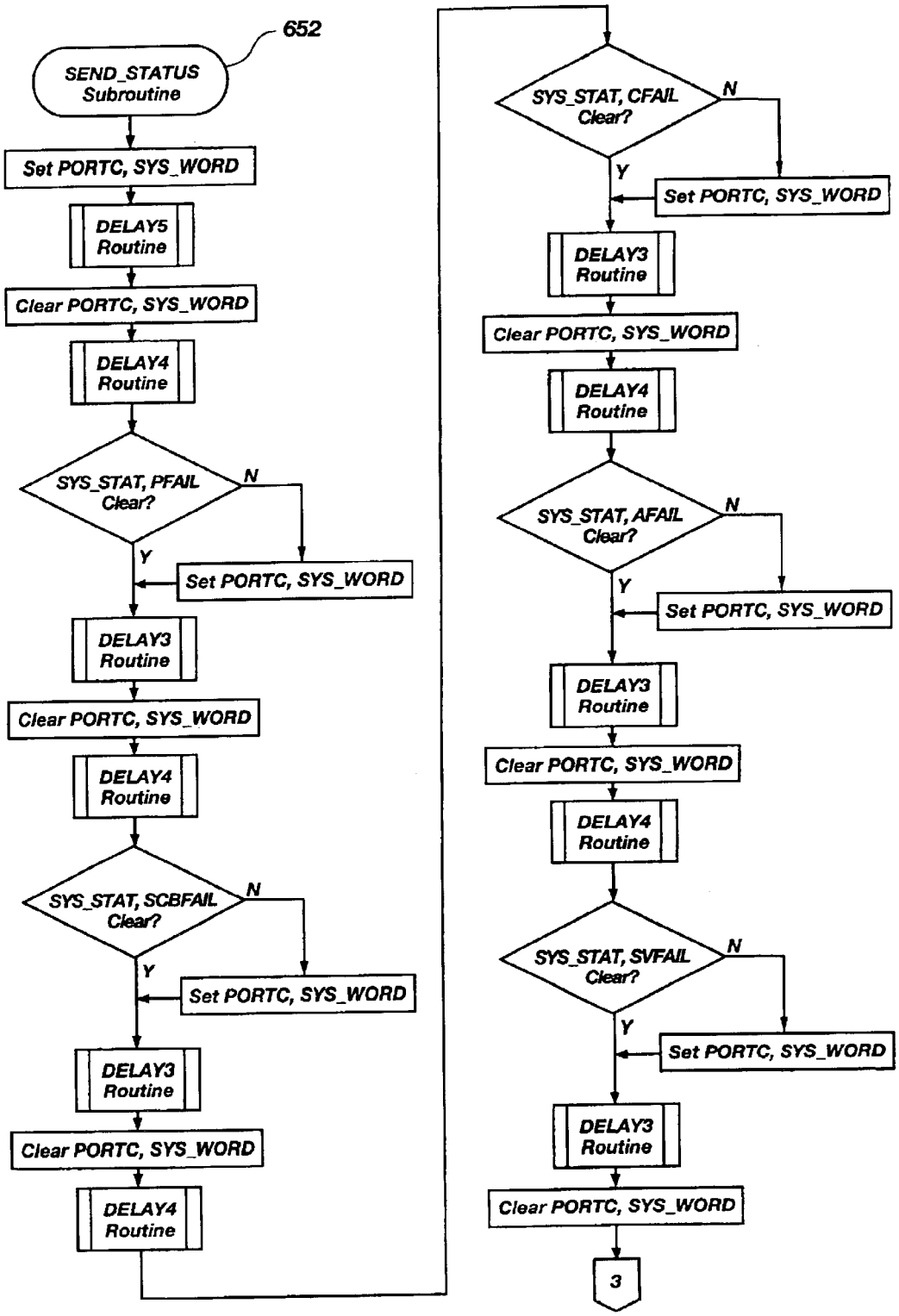
Figure 18:
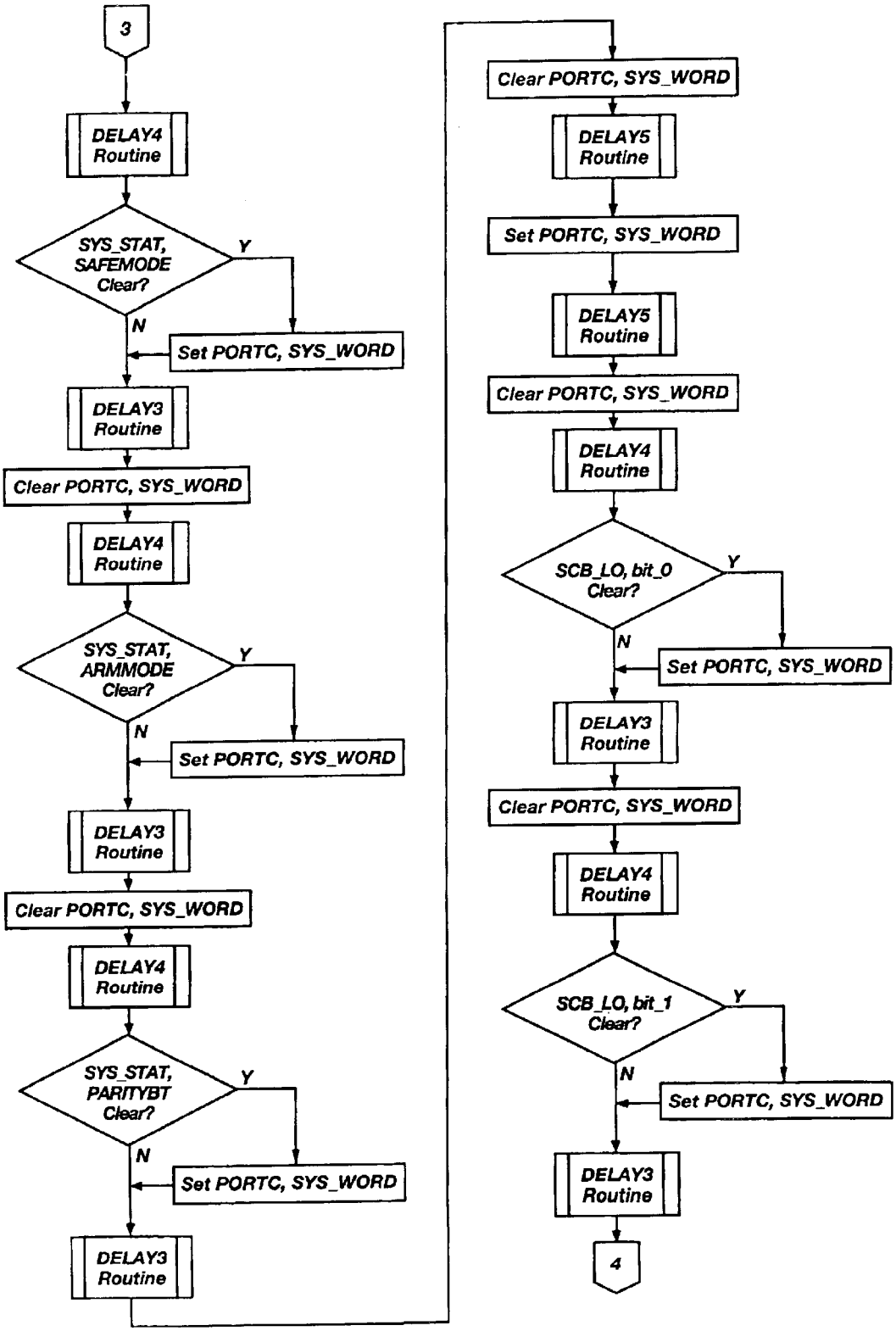
Figure 19:
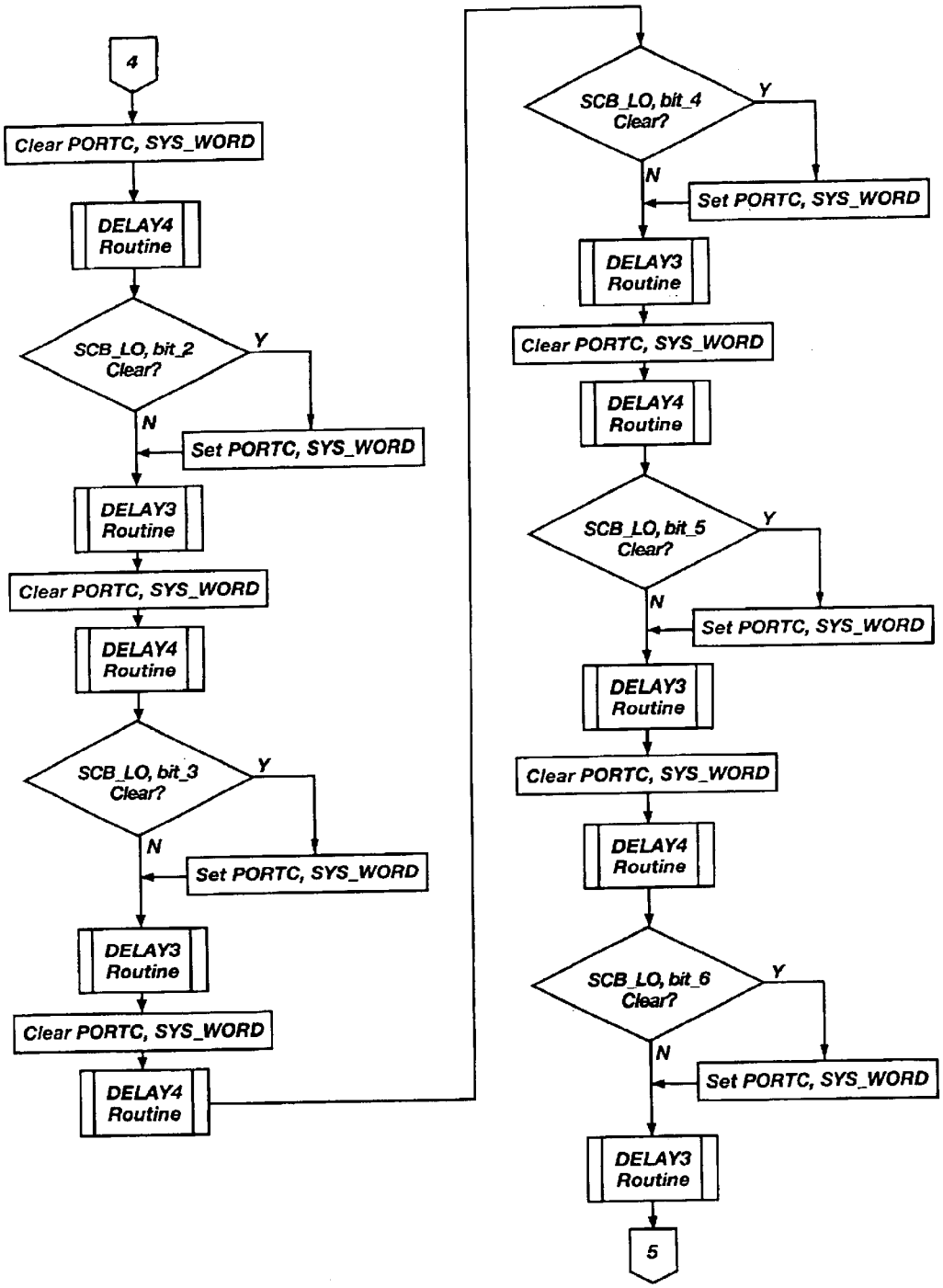
Figure 20:
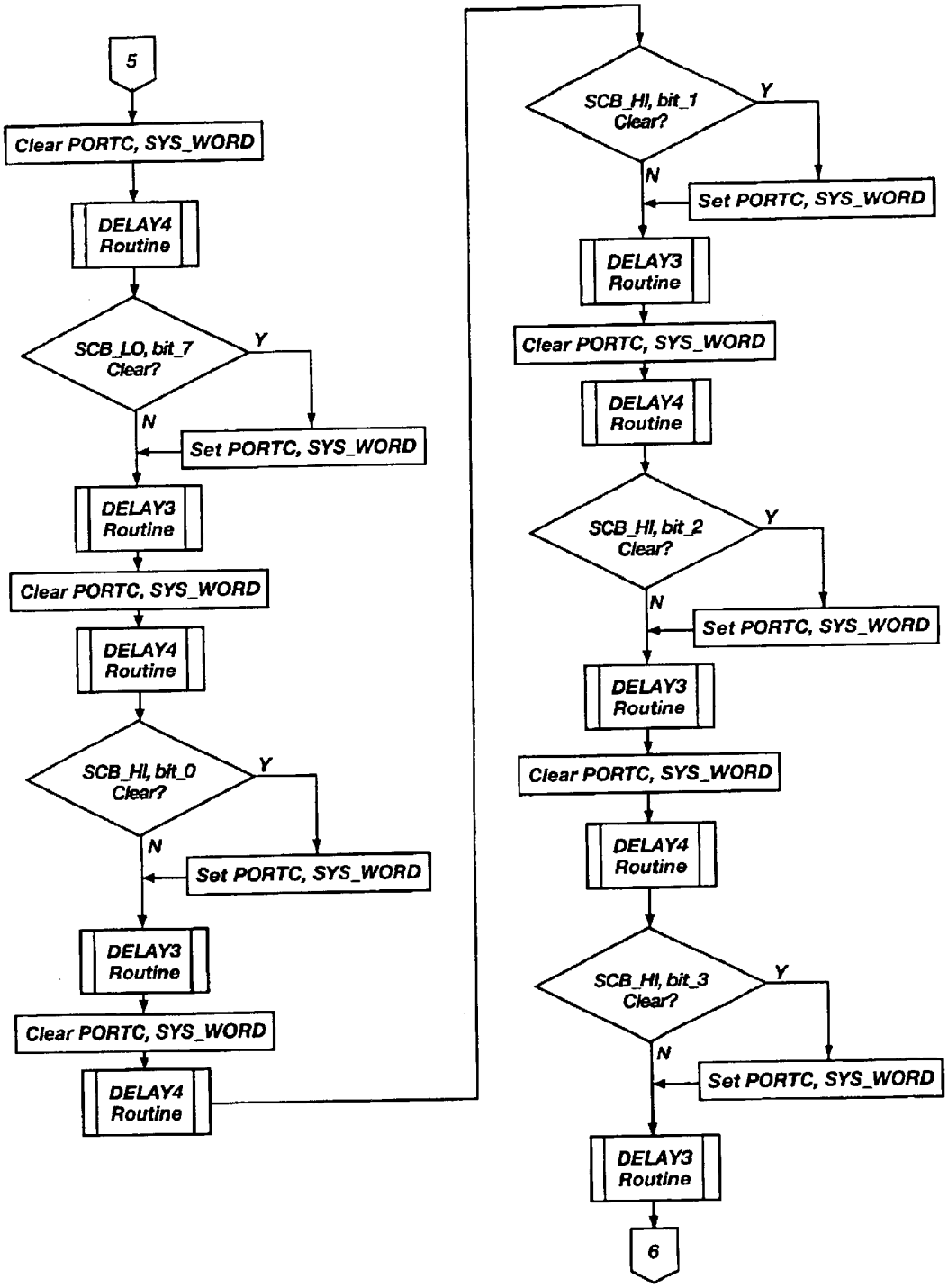
Figure 21:
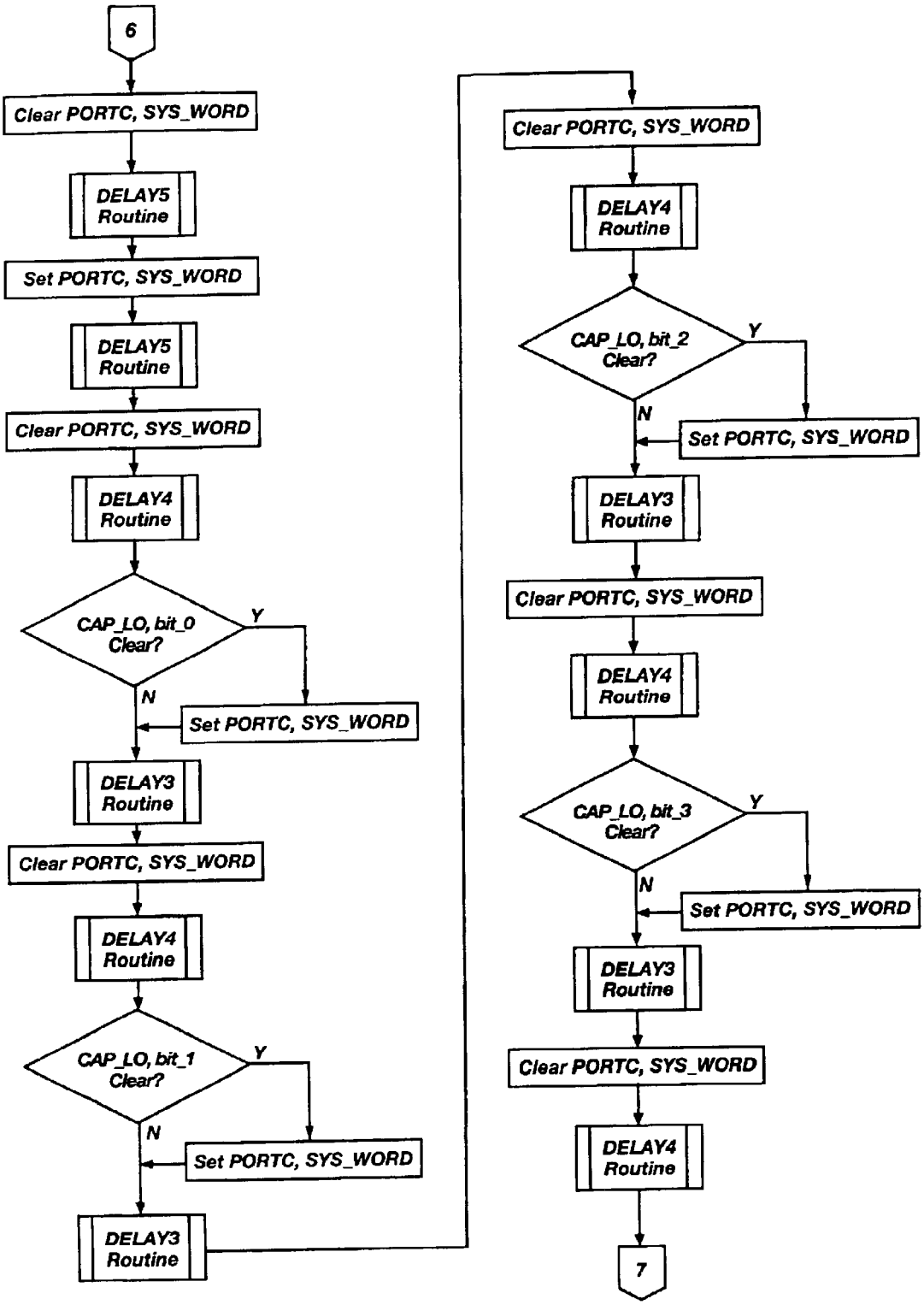
Figure 22:
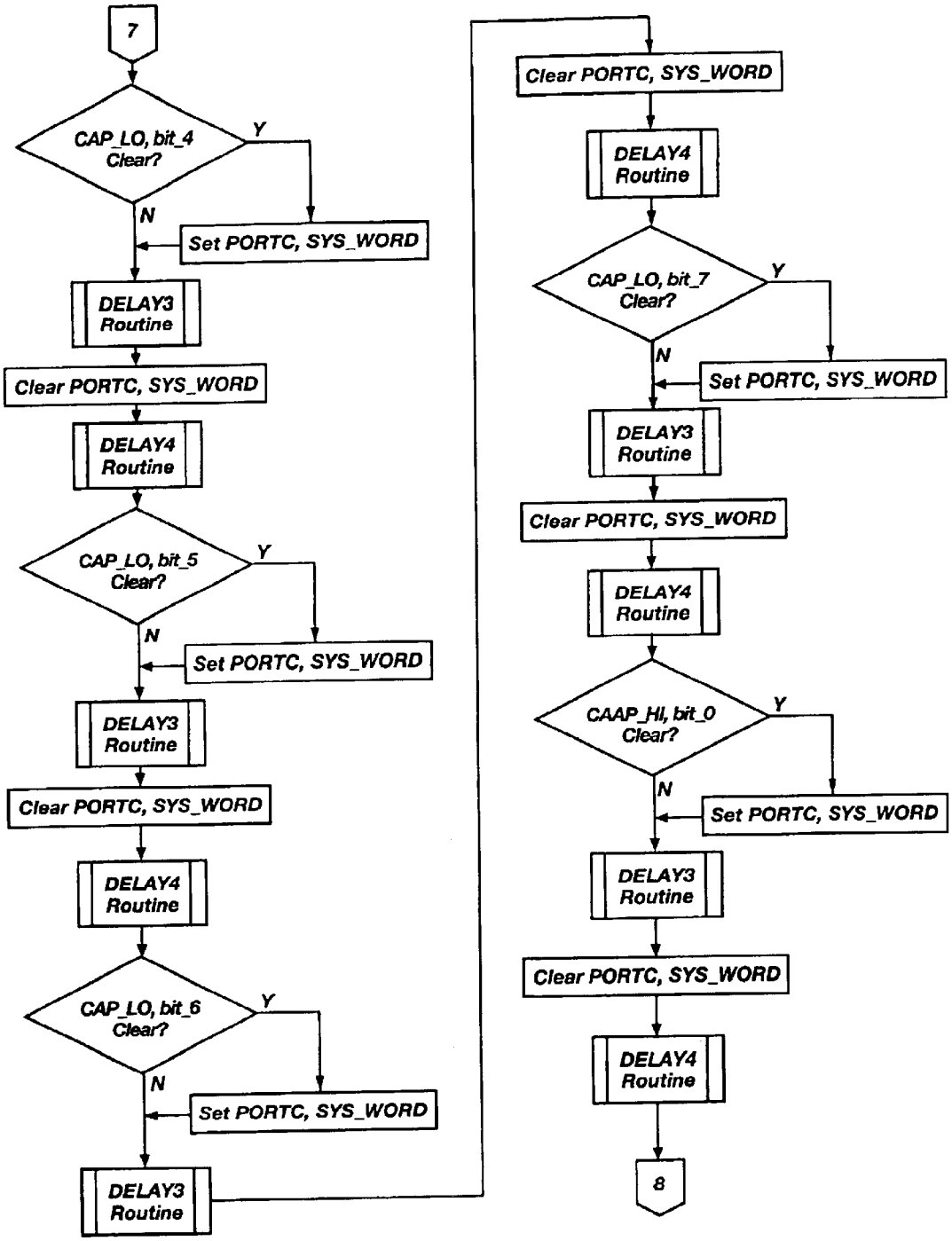
Figure 23:
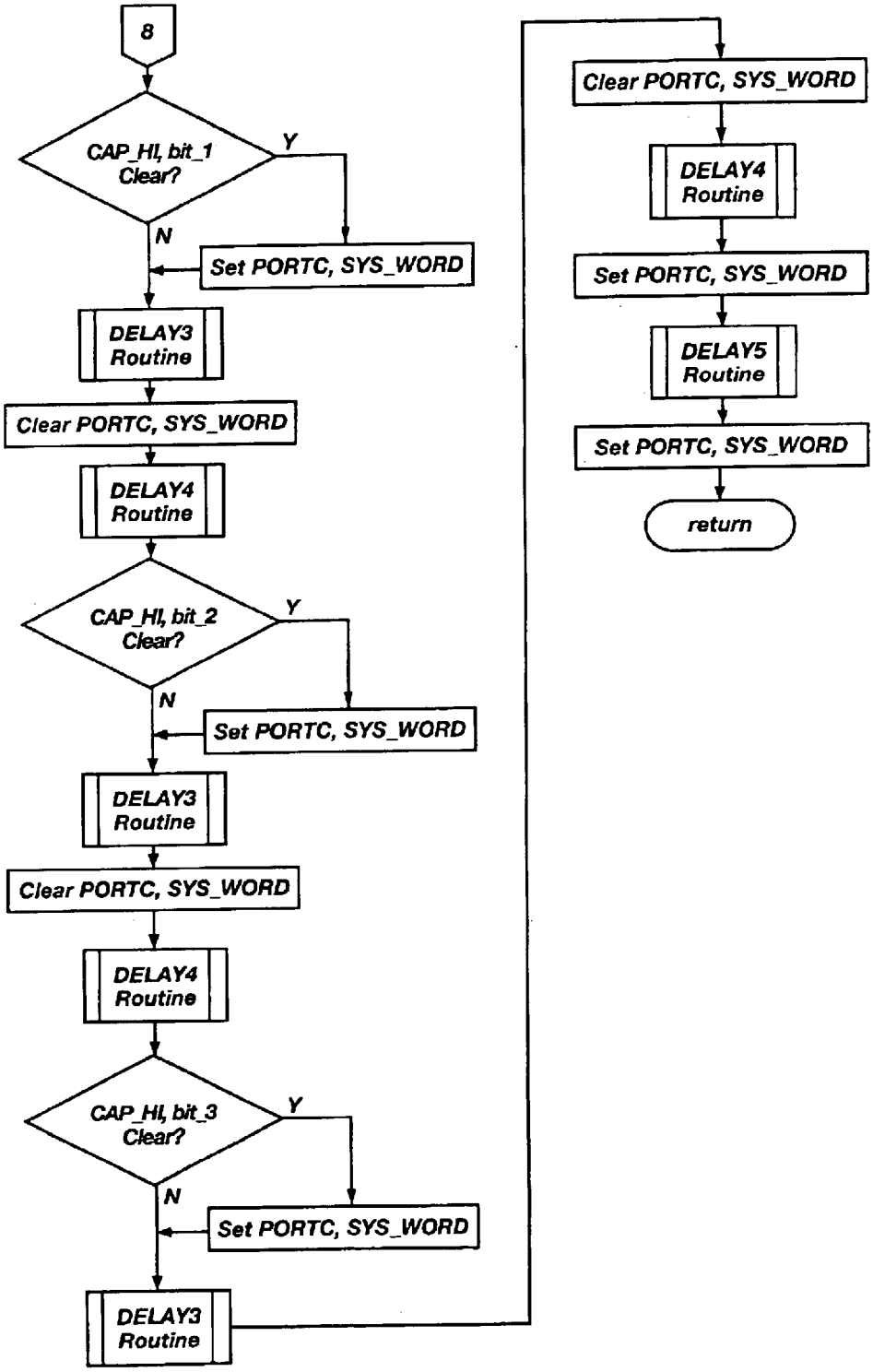

FIG. 16 shows processing flows associated with the "BLOOP Subroutine" 650, which runs as a background loop in the main program 600 and reads arm signal and capacitor C2 voltage levels. It continues until it receives an interrupt.

FIGS. 17 through 23 show processing flows associated with the "SEND_STATUS Subroutine" 652. These flows 652 provide the status output shown in FIG. 7. Delays are used, for example, to set the bit or pulse timing.

Figure 24:
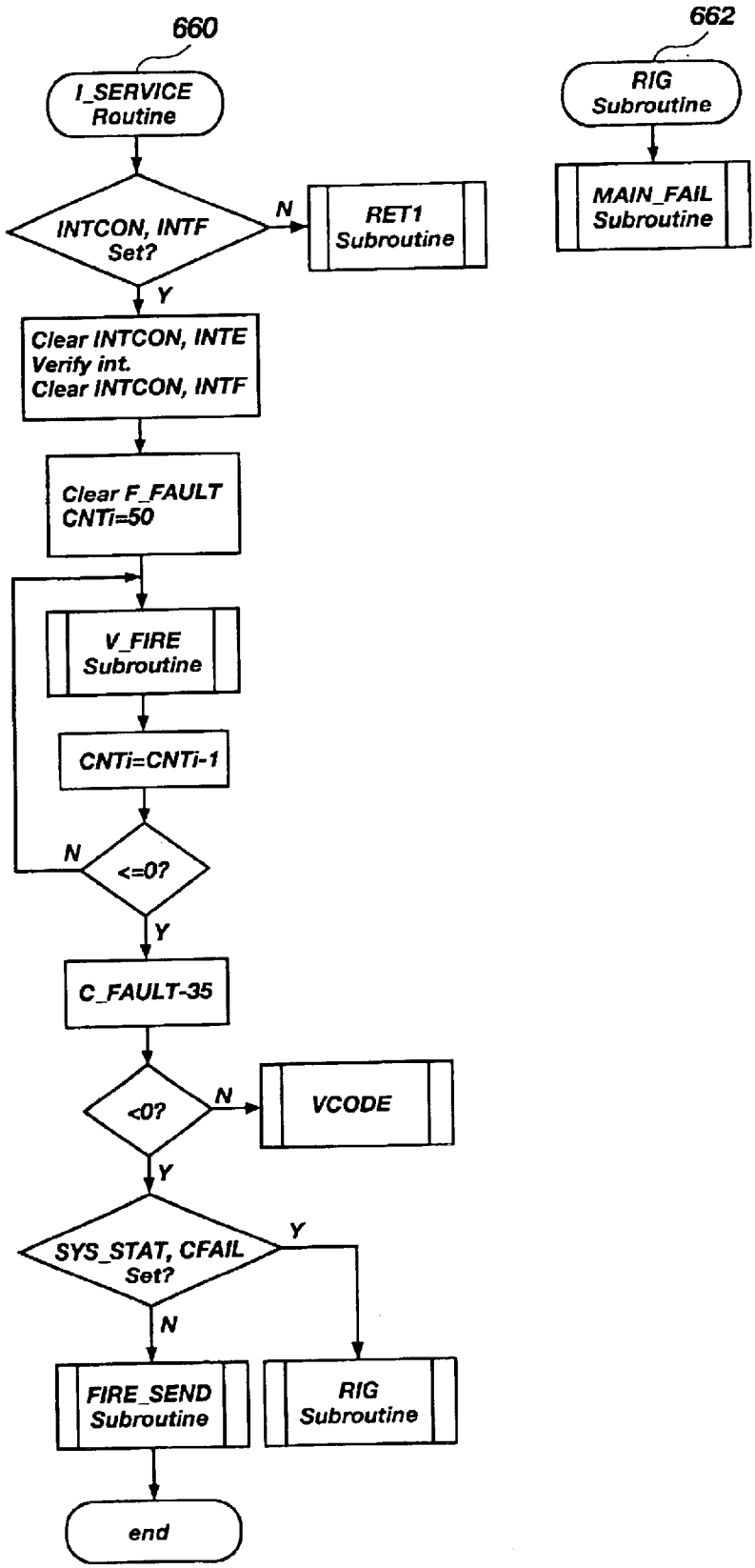

FIG. 24 shows processing flows "I_SERVICE Routine" 660 and "RIG Subroutine" 662 associated with interrupts. These processing flows 660, 662 include a check of the fire signal voltage.

Figure 25:
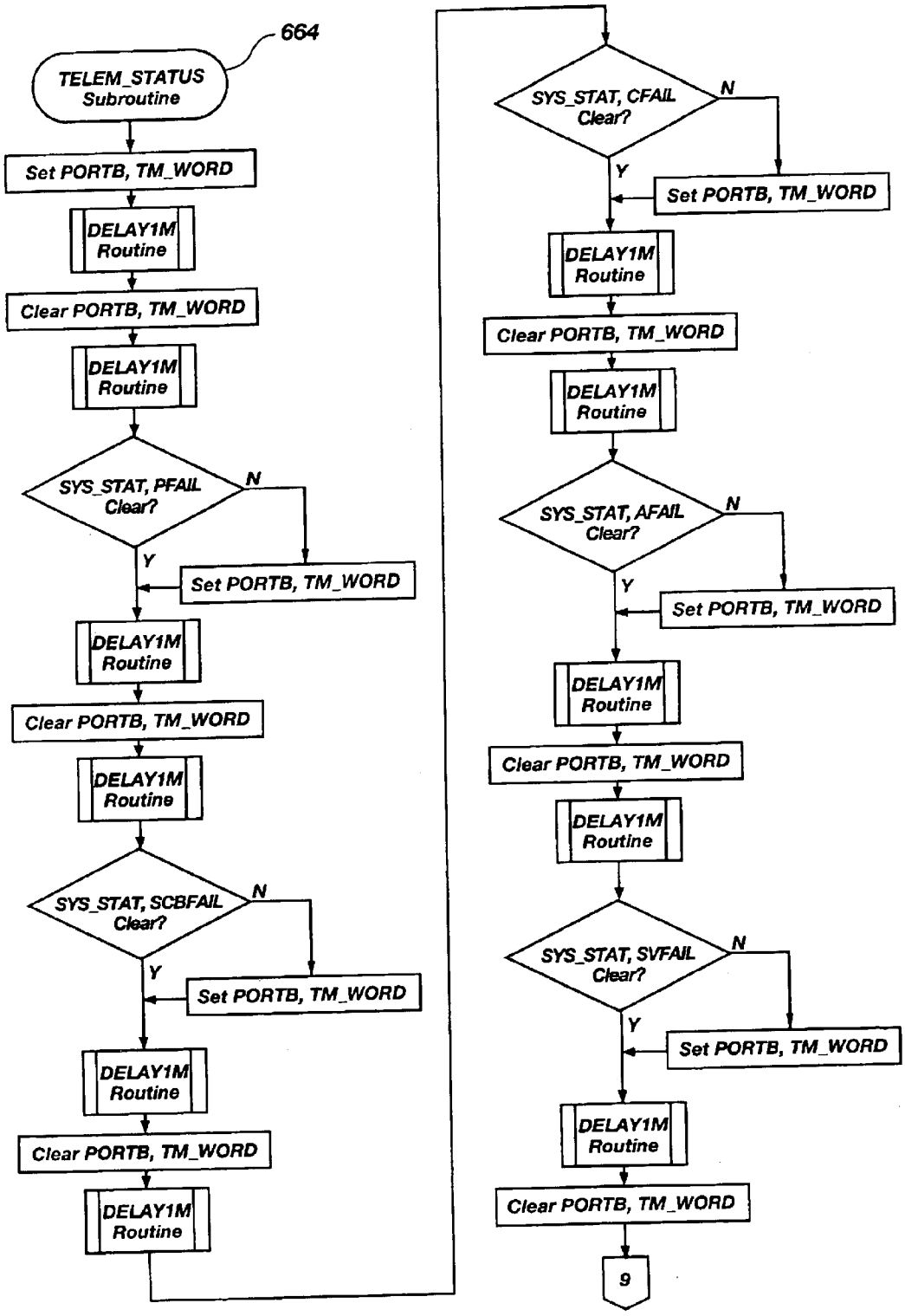
Figure 26:
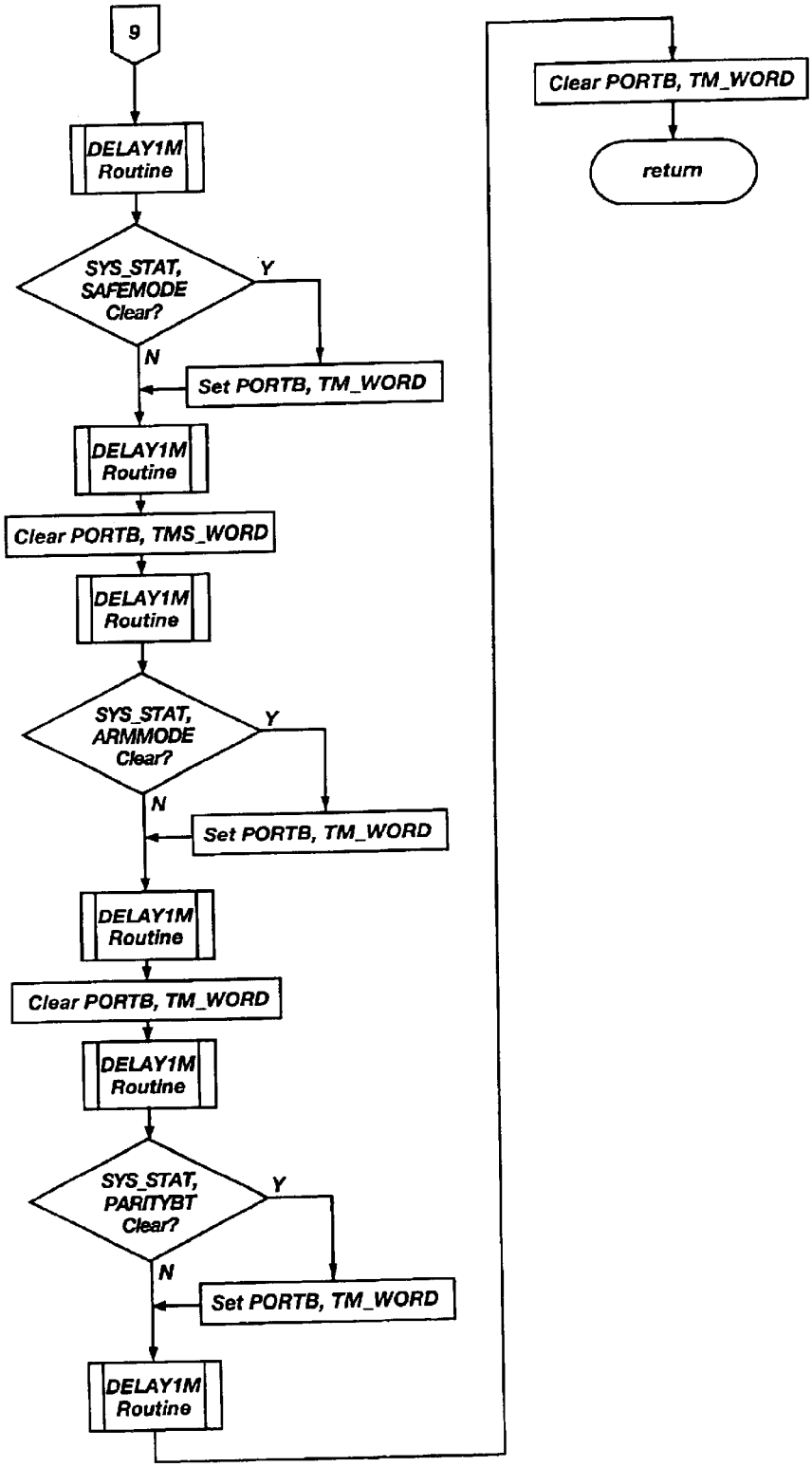

FIGS. 25 and 26 show processing flows associated with the "Telemetry Status Subroutine" 664. This processing 664 is associated with the telemetry outputs shown in FIG. 6.

Figure 27:
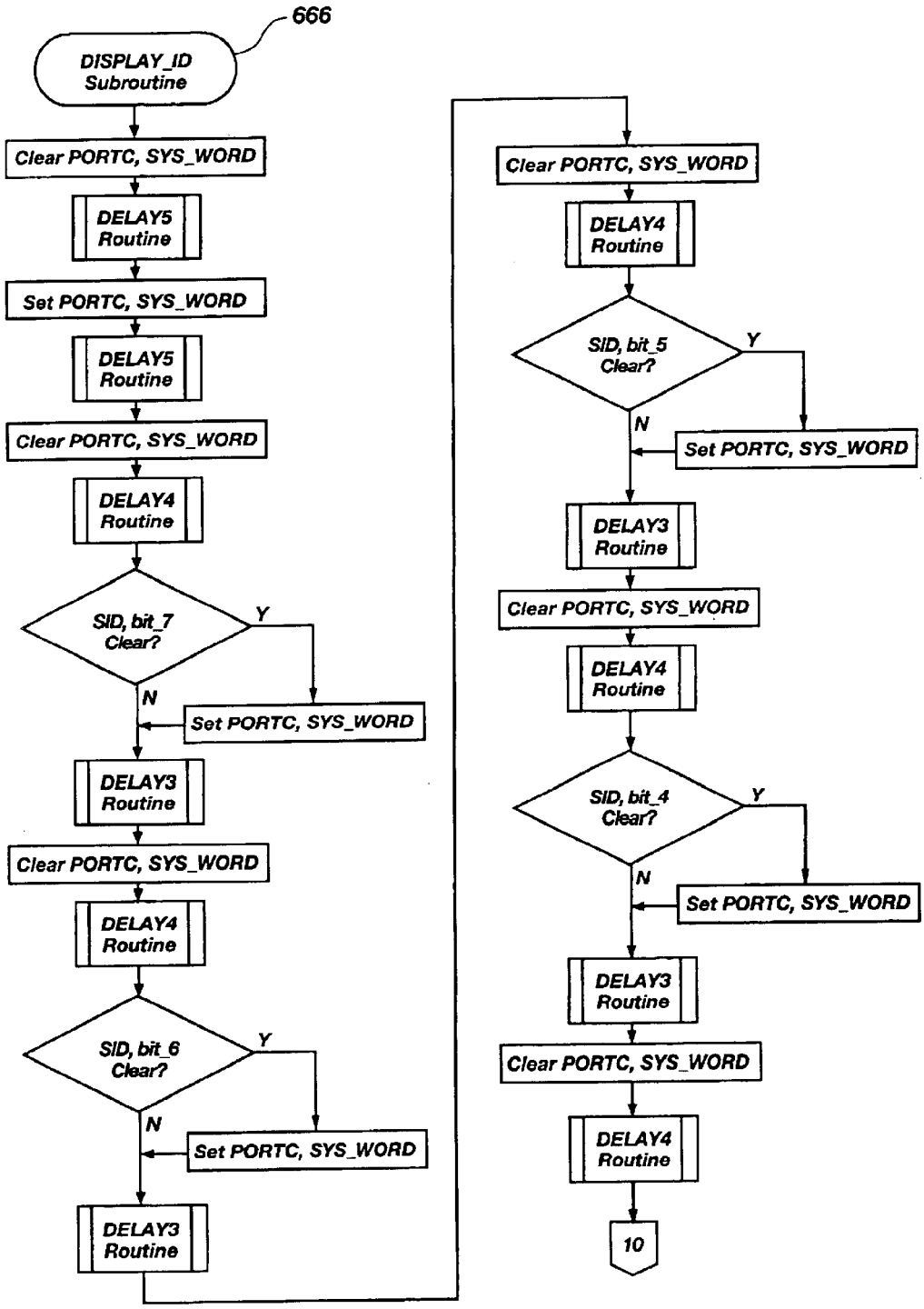
Figure 28:
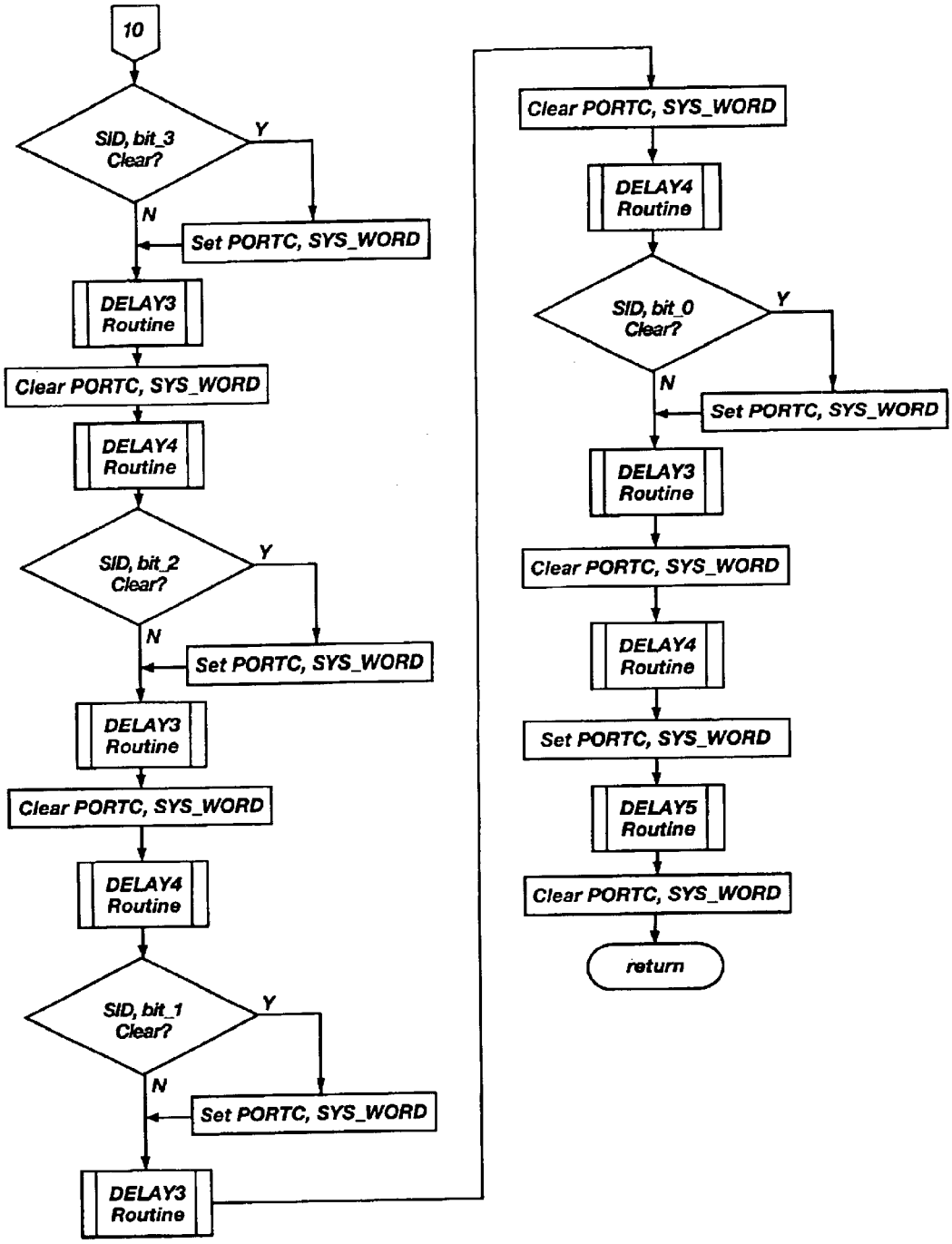

FIGS. 27 and 28 shows show processing flows associated with the "DISPLAY_ID Subroutine" 666, which displays the version of the software currently running. The display is made in the preferred embodiment only once, on power up.

Figure 29:
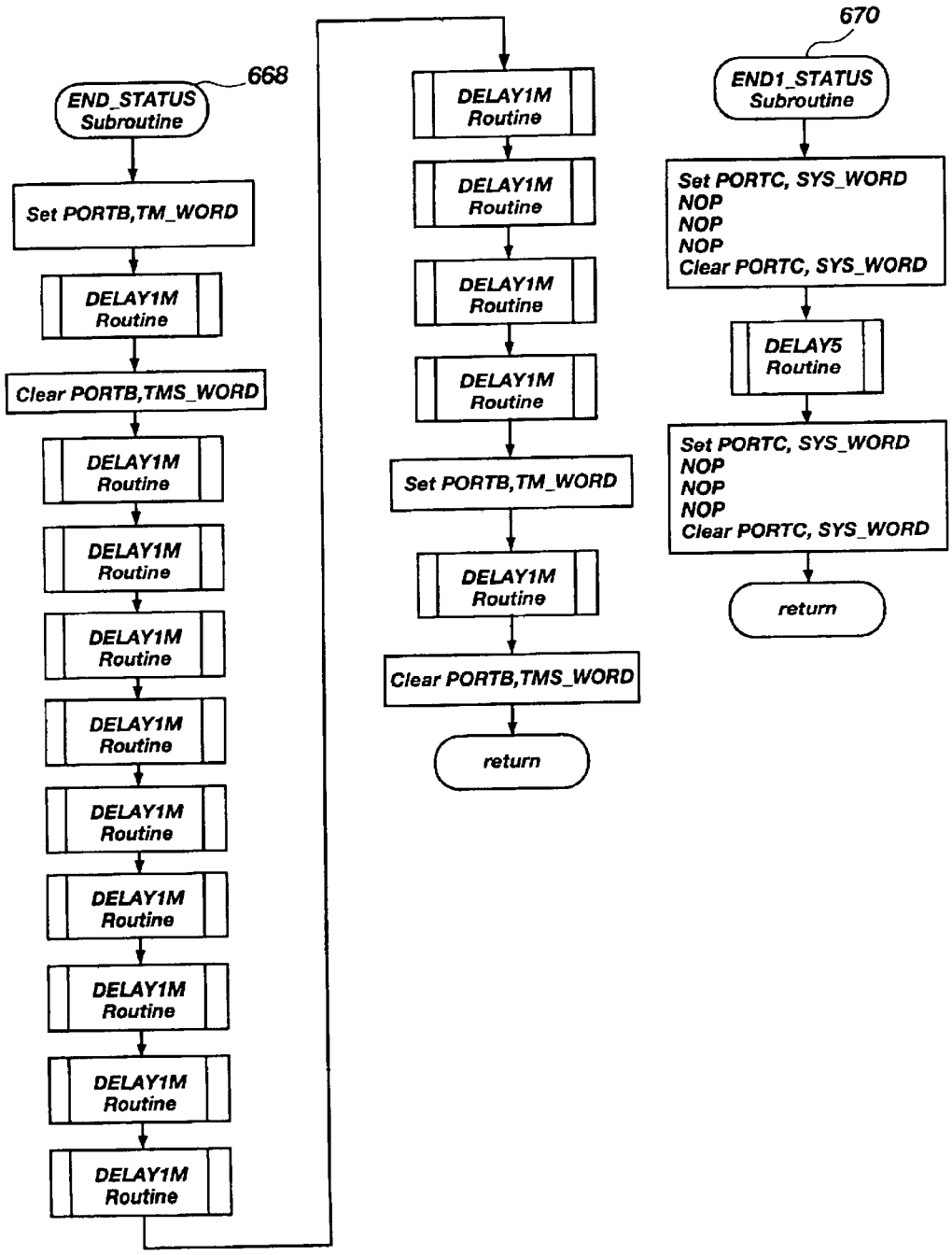

FIG. 29 provides processing flows associated with the "END STATUS Subroutine" 668 and the "END1_Status Subroutine" 670, which provide a telemetry output after fire processing has occurred and a fire of the SCB 119 has taken place.

Figure 30:
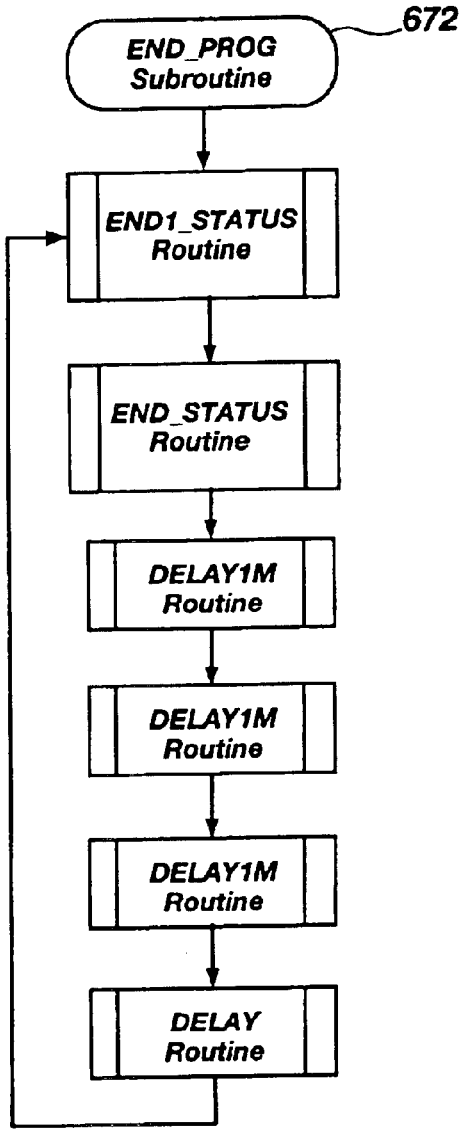

FIG. 30 shows processing associated with the "END_PROGRAM Subroutine" 672, which occurs after active processing has been completed and the system is ready to go into an idle or quiescent state.

Figure 31:
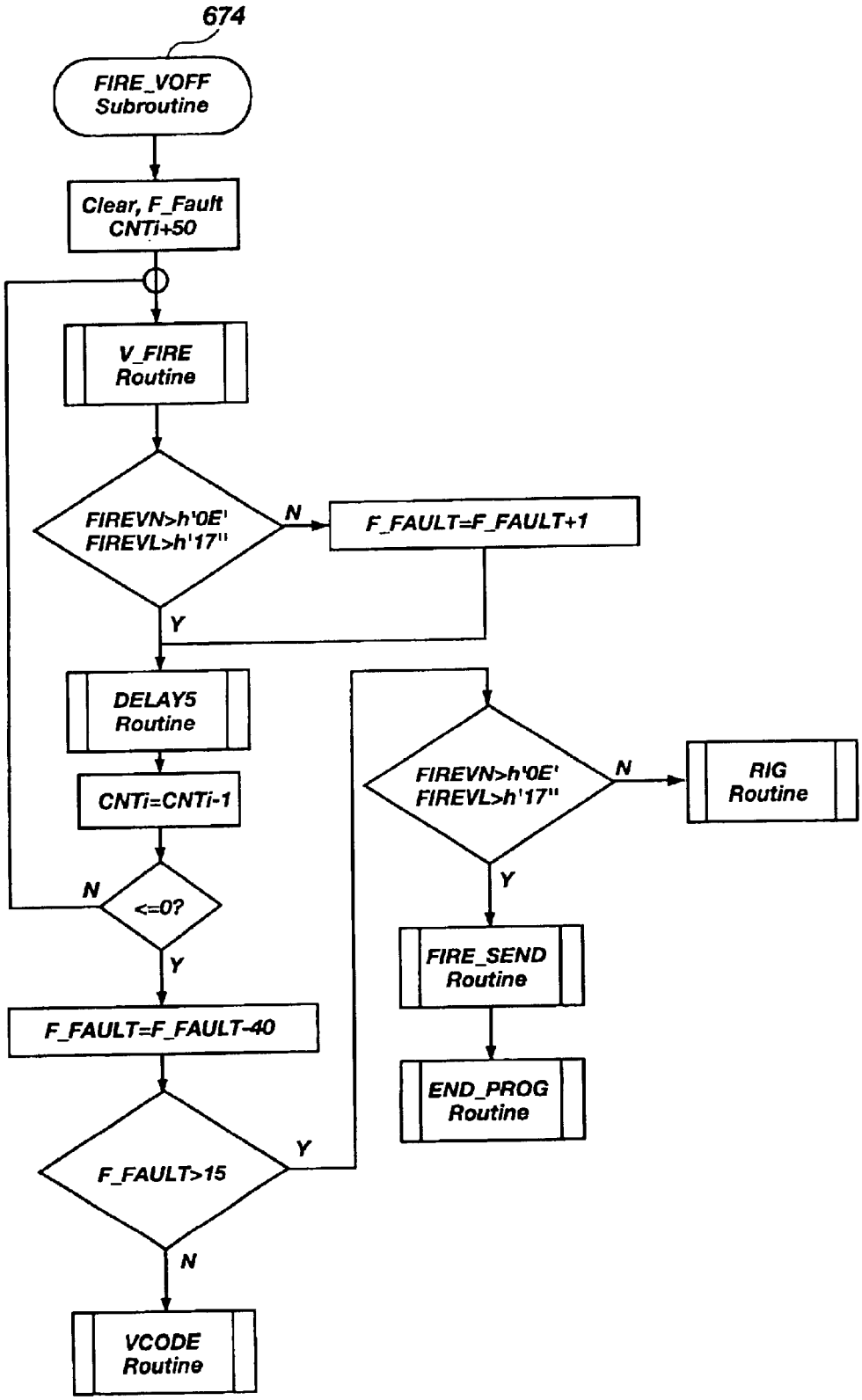

FIG. 31 shows processing associated with the "FIRE_VOFF Subroutine" 674. This processing 674 is called after fire processing has been completed and a fire condition has occurred. It can be used to prevent battery drain. In the preferred implementation, the FIRE_VOFF subroutine 674 is run approximately 10 milliseconds after the completion of prerequisite processing.

Figure 32:
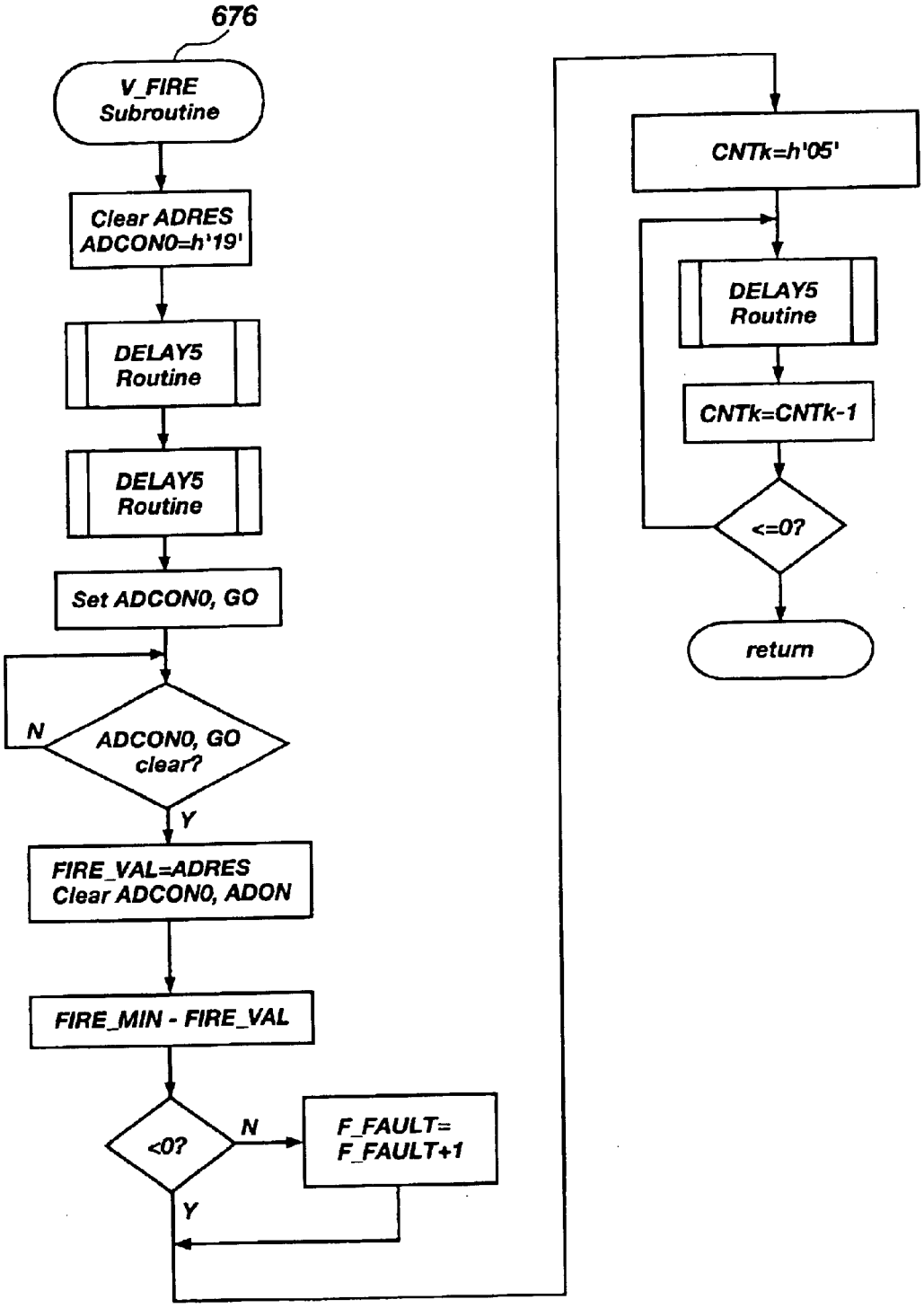

FIG. 32 shows processing flows associated with the "VERIFY_FIRE Subroutine" 676, which is used, among other things, to verify that the fire voltage is above the threshold on the fire interrupt. In the currently preferred implementation, the VERIFY_FIRE subroutine 676 is called by other subroutines approximately 50 times in the course of fire signal processing. To obtain a valid verification, verification must be made or passed in at least 35 out of 50 attempts.

Figure 33:
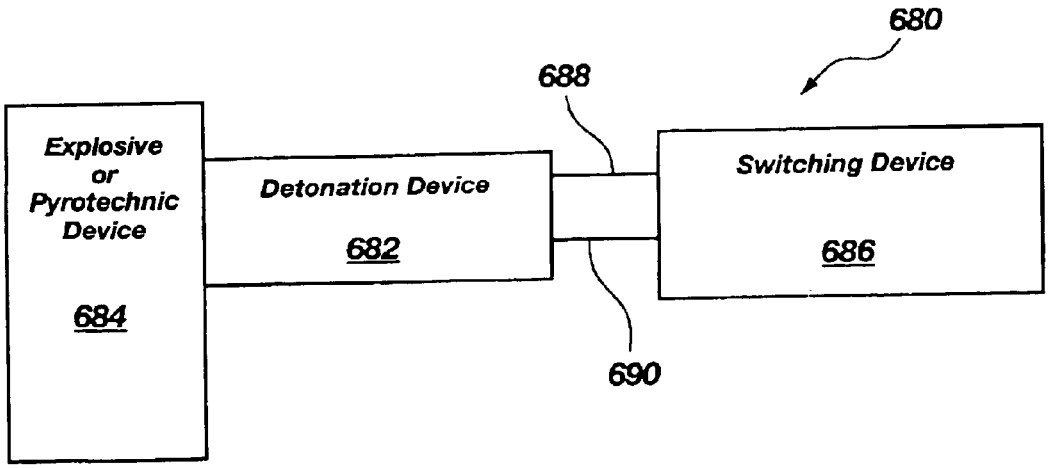
FIG. 33 is a block diagram of an explosive or pyrotechnic device configured to be activated by a detonation device electrically coupled to an electronic switching device, according to another embodiment of the present invention.
Figure 4A:
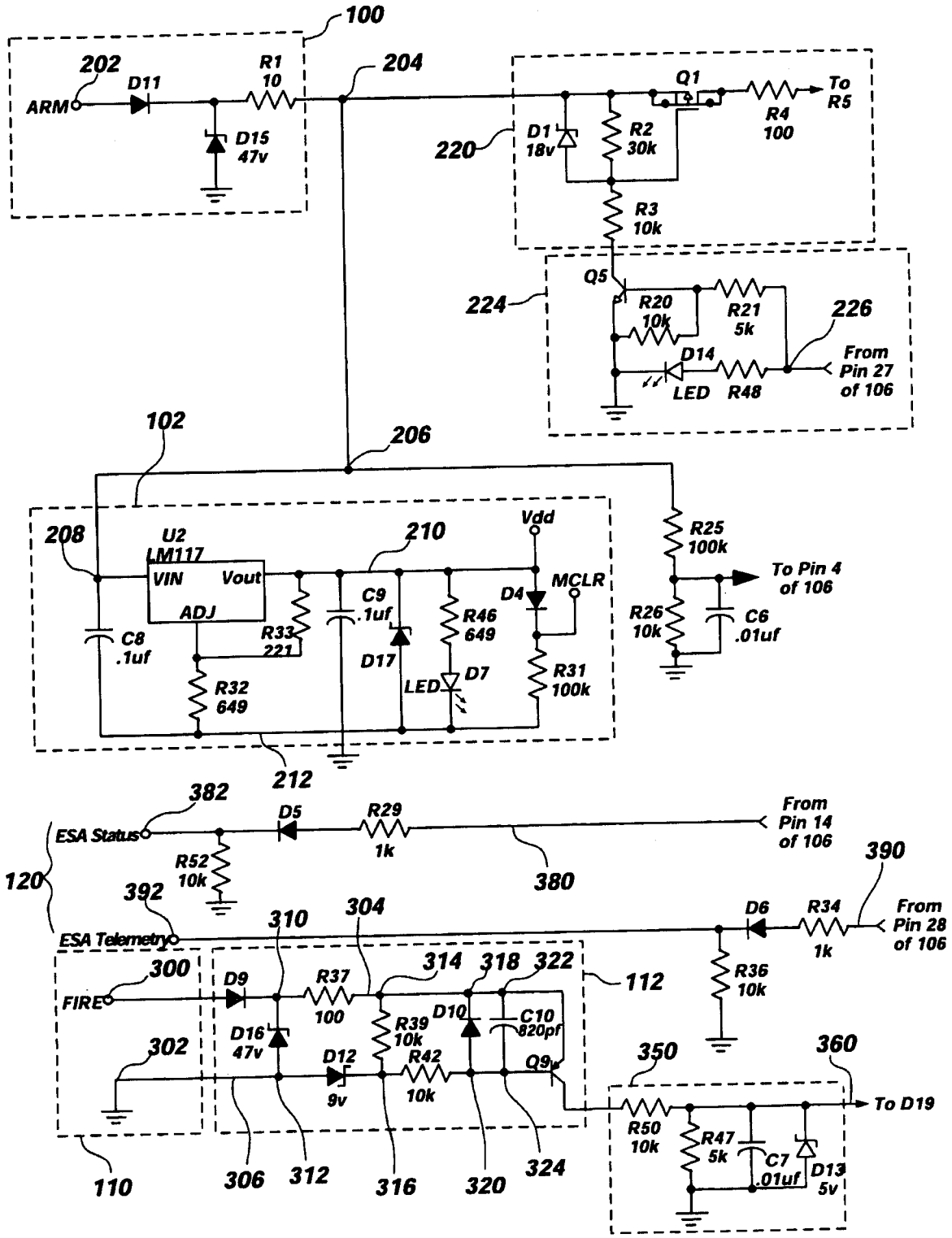
Figure 4C:
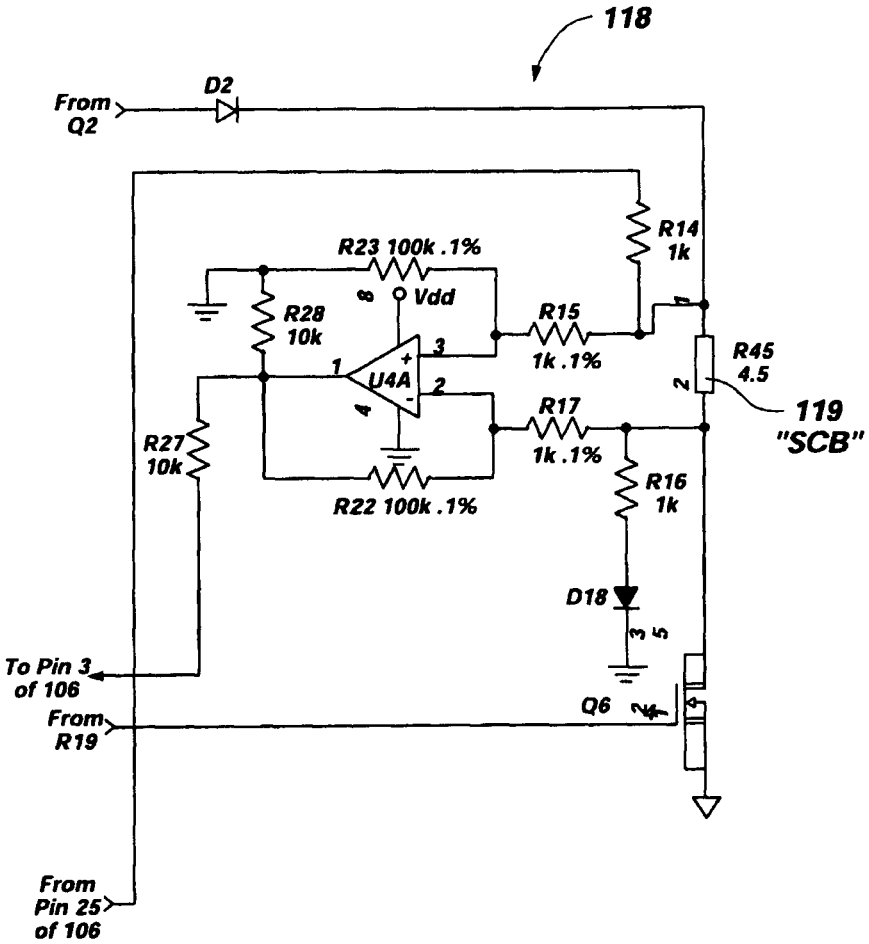
Figure 5:
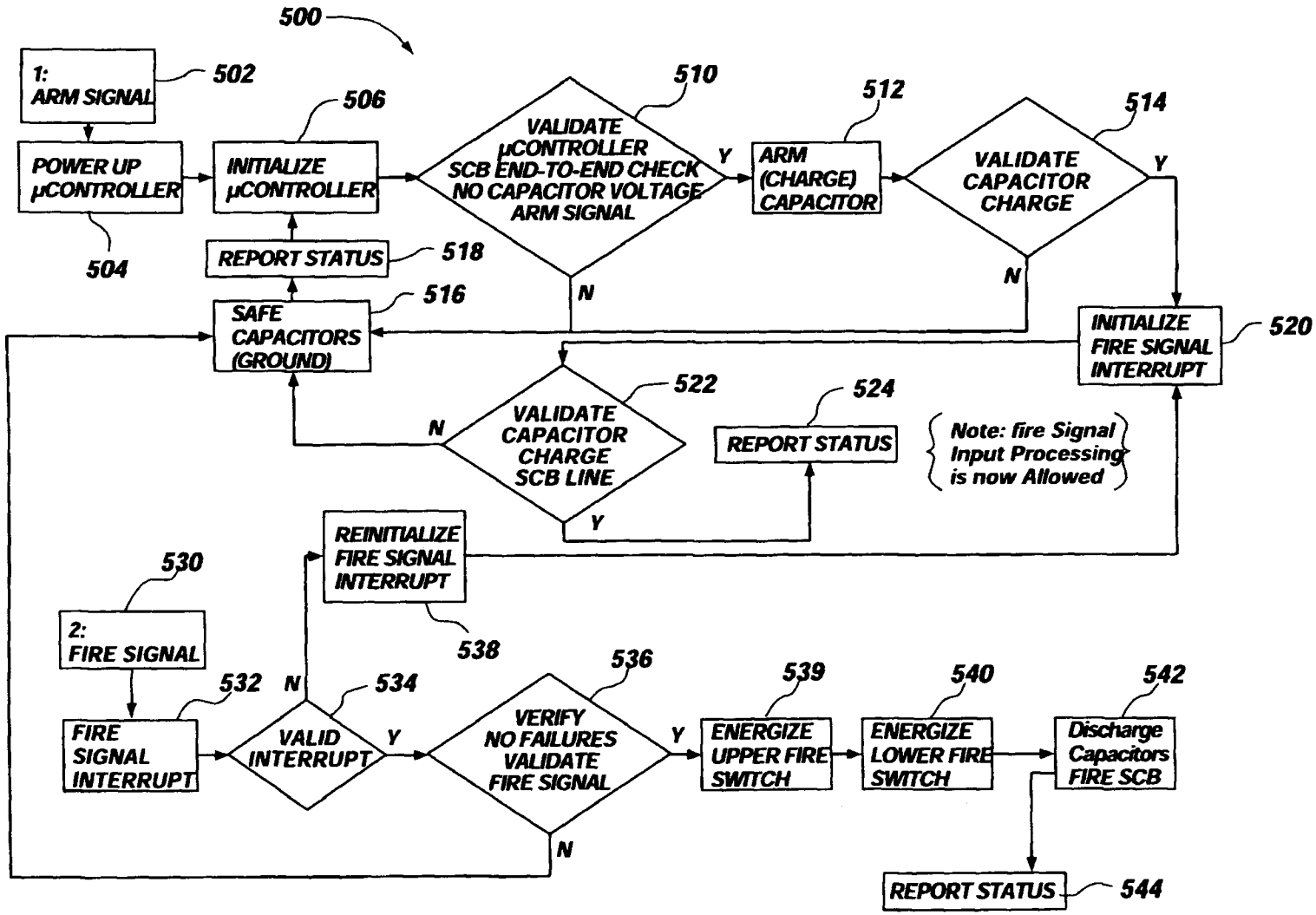
Figure 8:
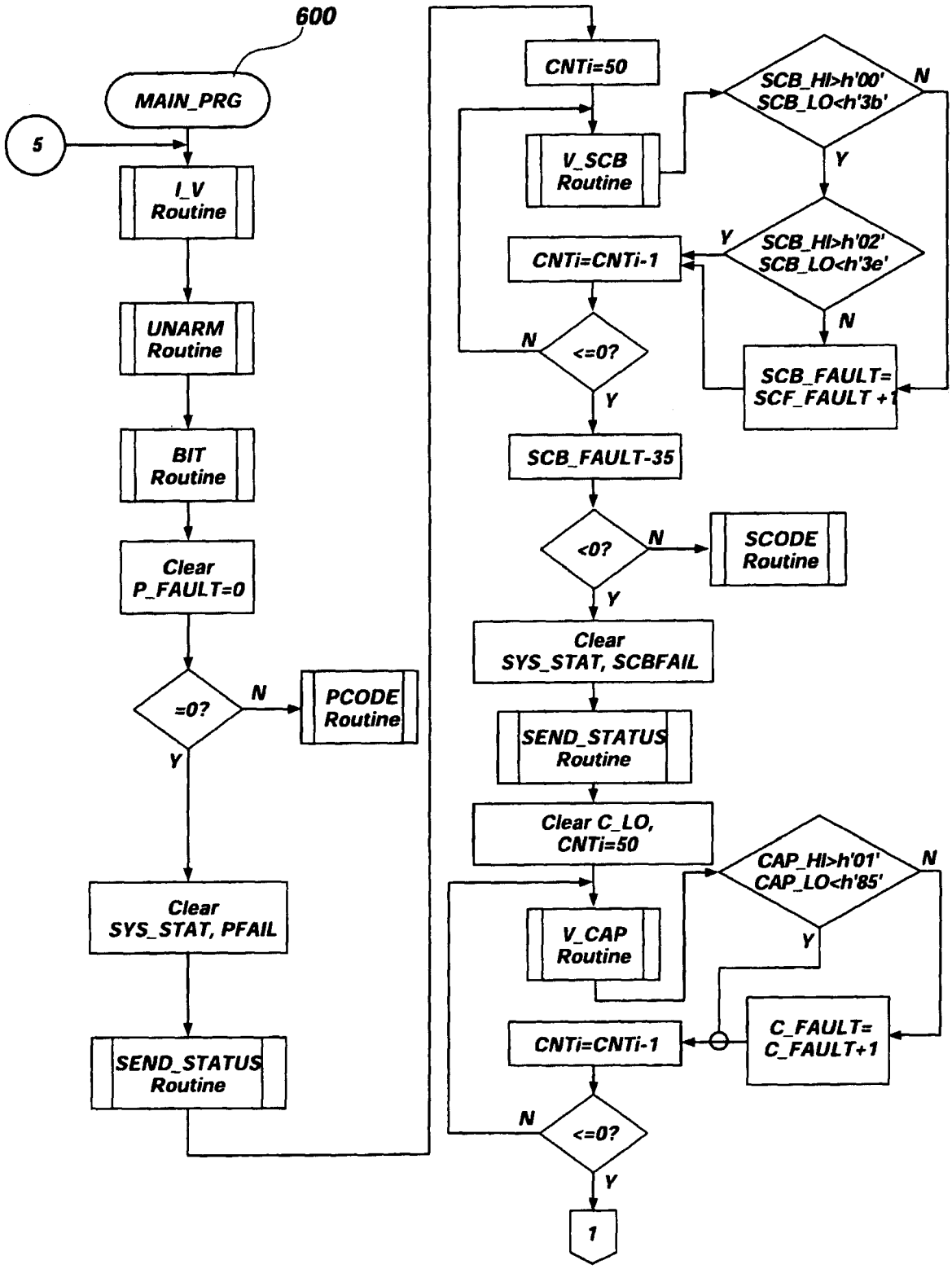
Figure 13:
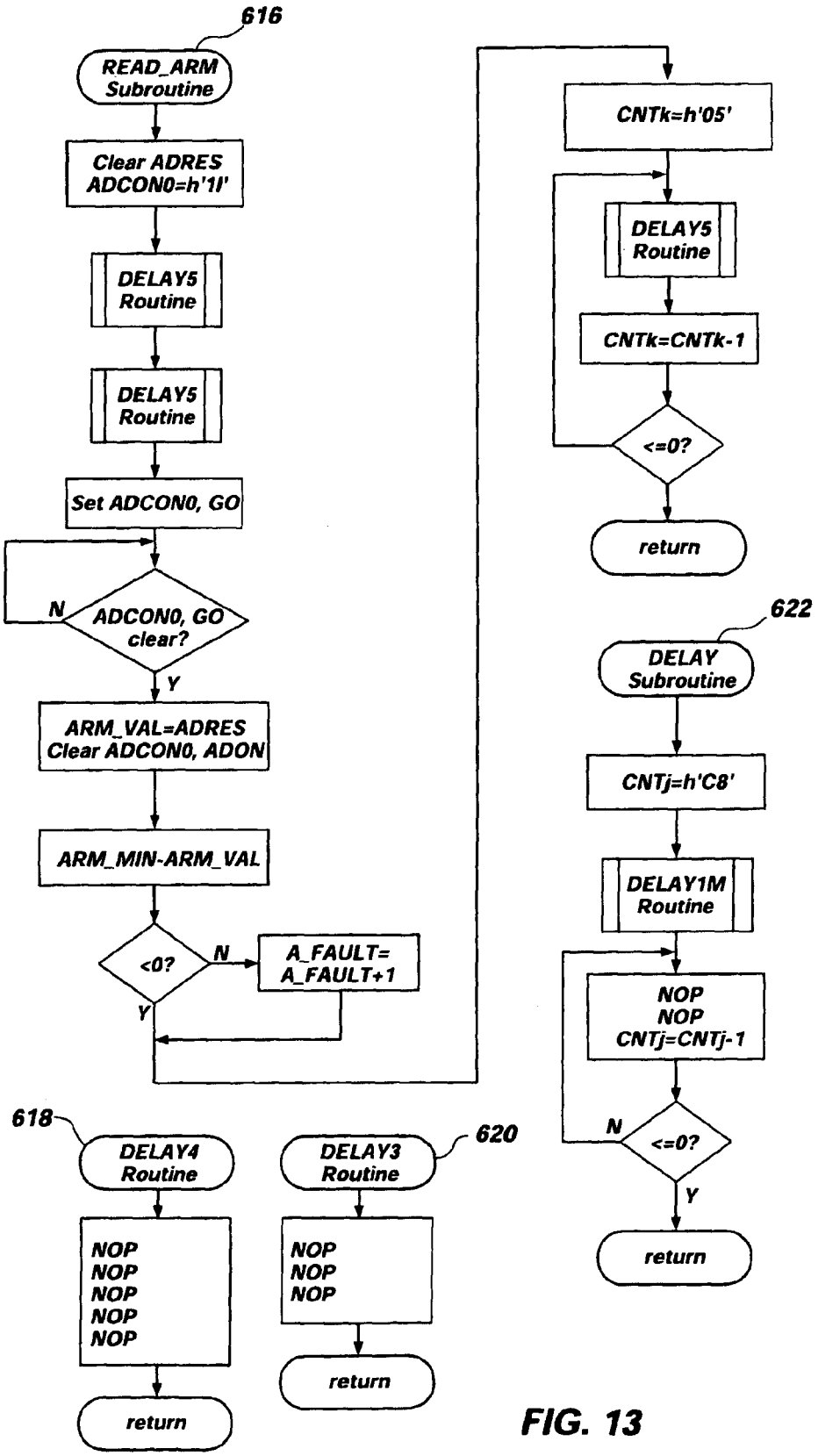
Figure 14:
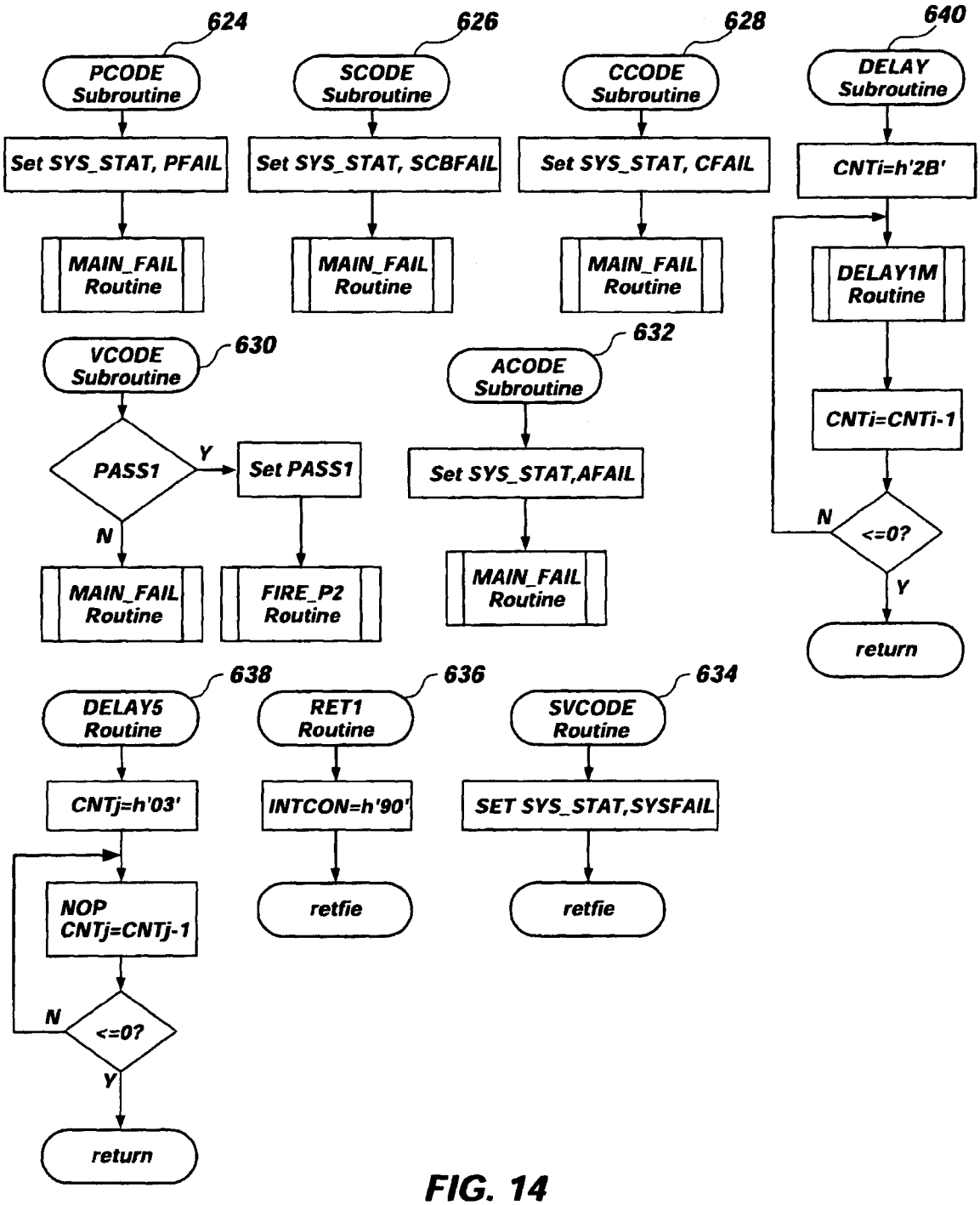
Figure 16:
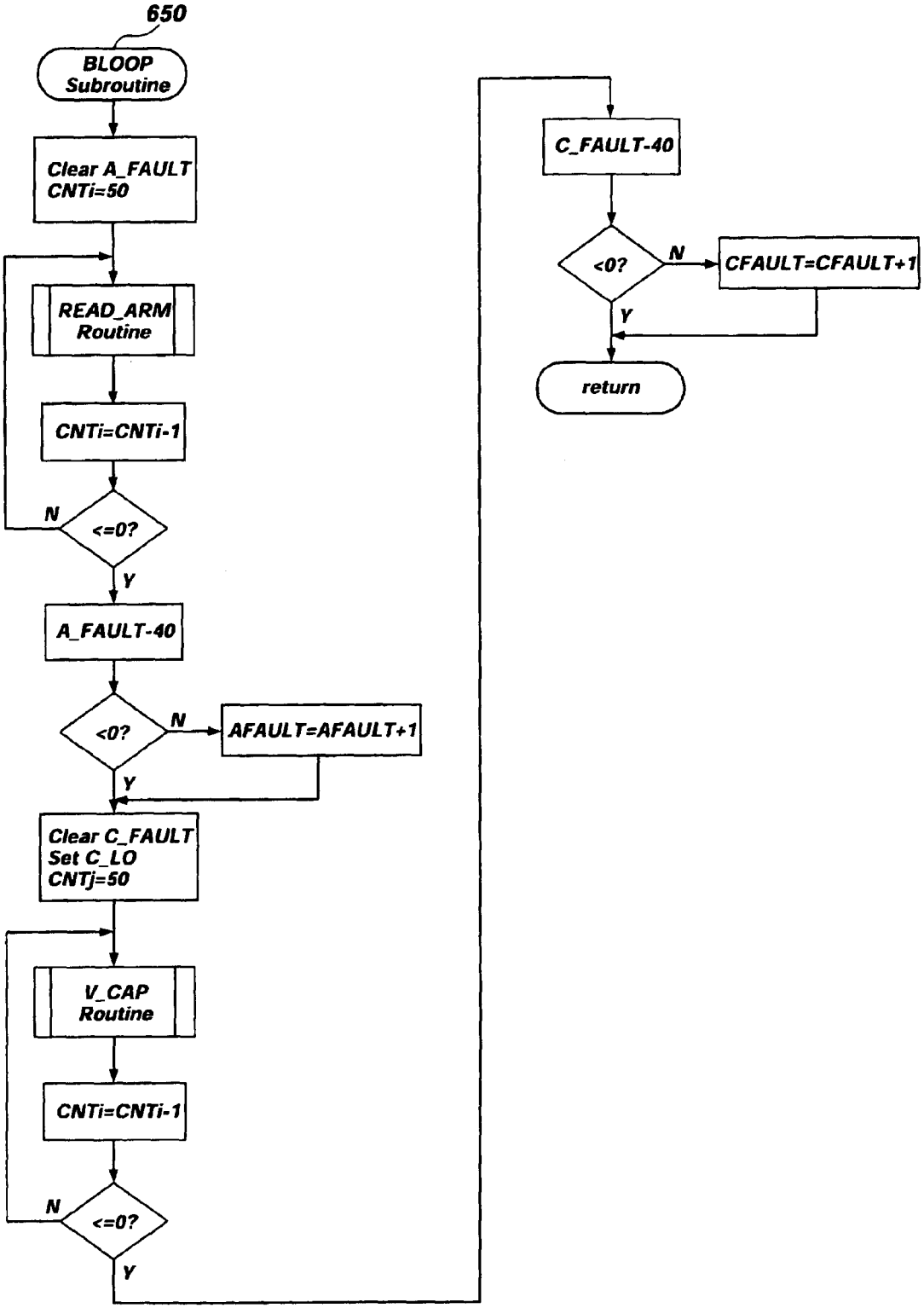
Figure 24:
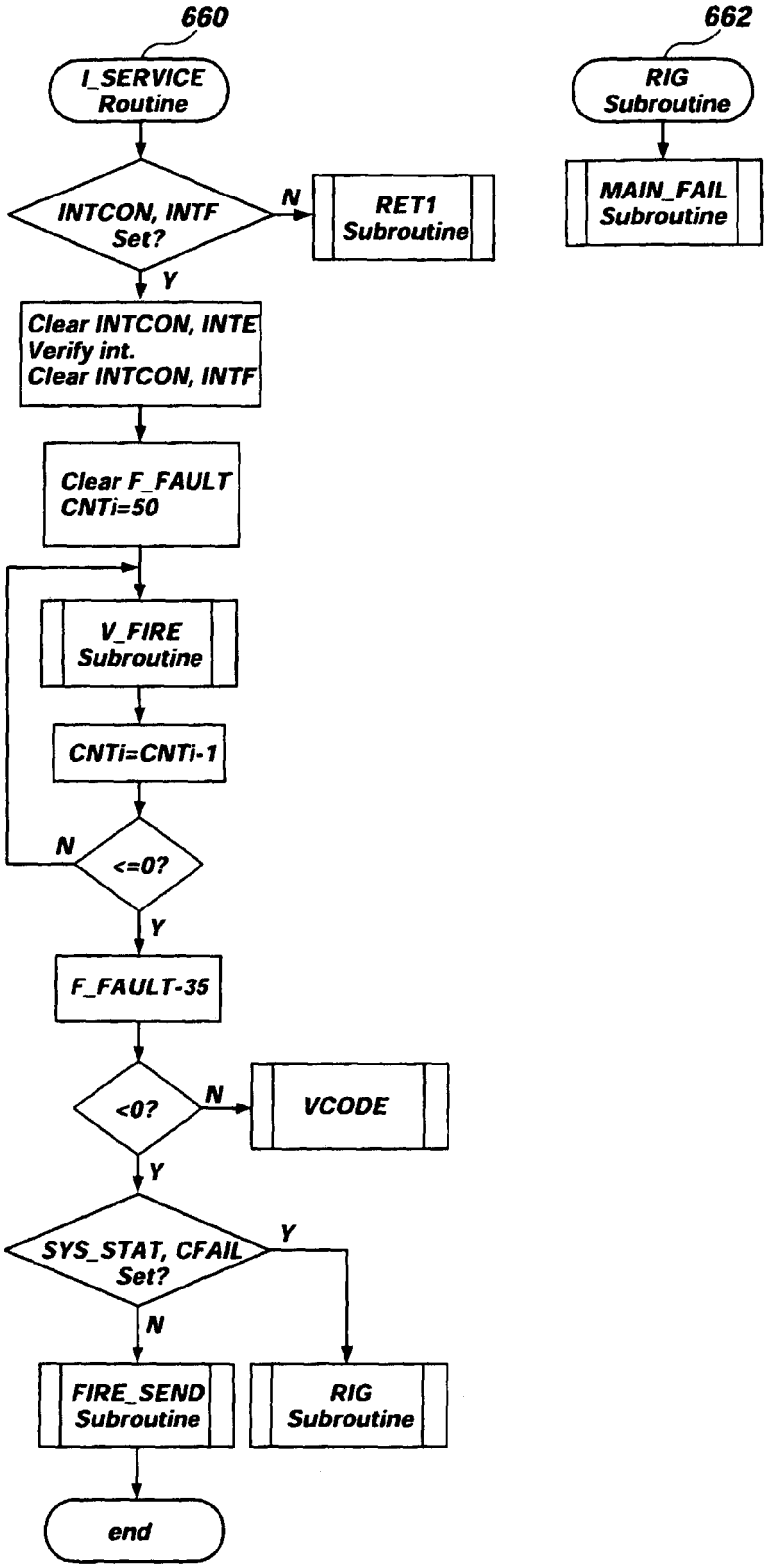
Figure 31:
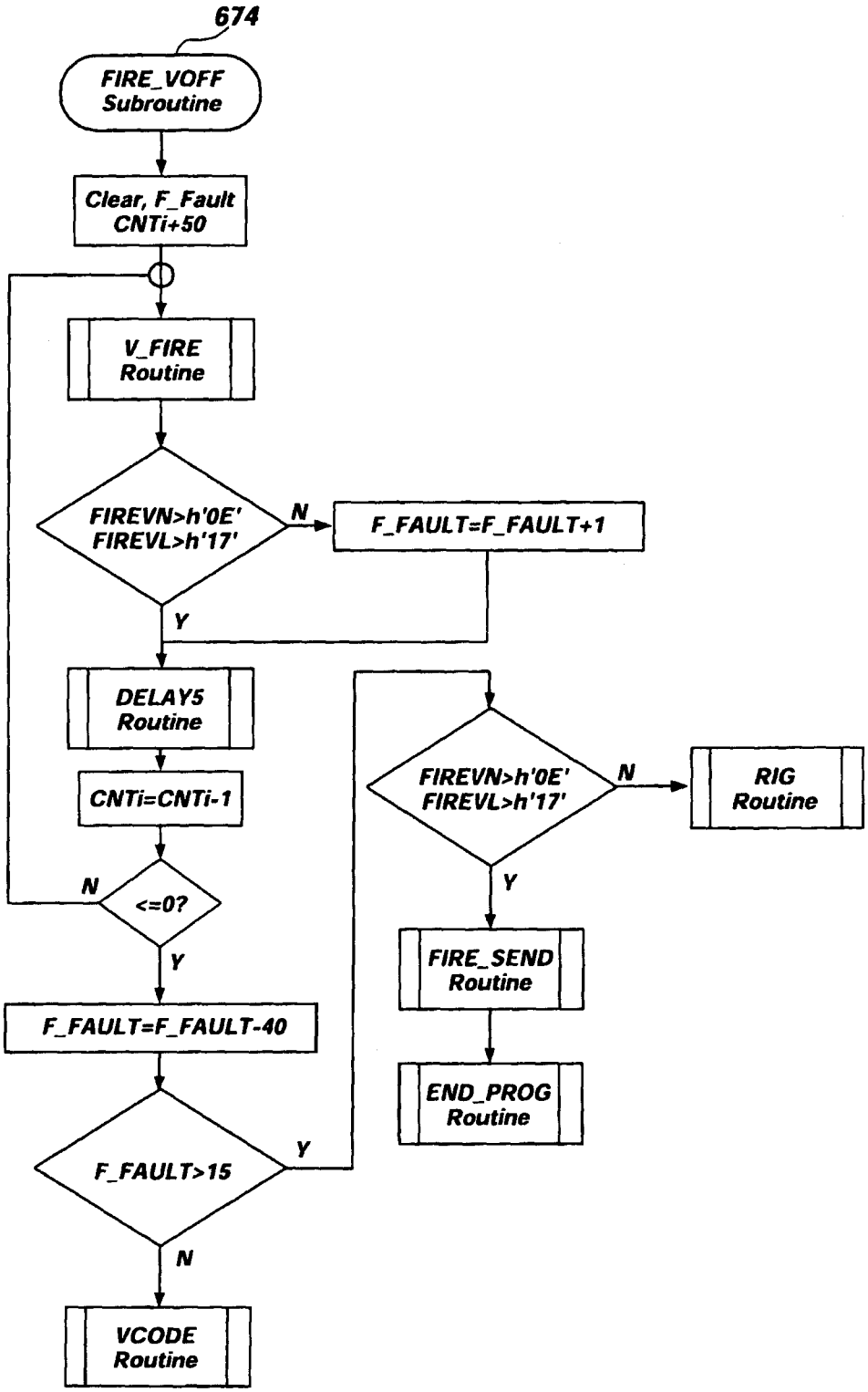

FIG. 33 is a block diagram of an electronic switching system 680 comprising a detonation device 682 configured and positioned to detonate an explosive or pyrotechnic device 684. The detonation device 682 is electrically coupled to an electronic switching device 686, such as the electronic switching device 10 shown in FIGS. 1 through 4C. The detonation device 682 may comprise, by way of example only and not by limitation, an SCB device. The electronic switching device 686 may be configured to arm itself upon receiving an "ARM" signal. The electronic switching device 686 may further be configured to discharge an energy source (not shown) across a first terminal 688 and a second terminal 690 of the detonation device 682 upon receiving and validating a "FIRE" signal. The explosive or pyrotechnic device 684 is configured and positioned so as to initiate or explode when the energy source discharges across the terminals 688 and 690 of the detonation device 682.

Additional advantages and modifications will readily occur to those skilled in the art. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. An electronic switching device configured to activate a detonation device, the electronic switching device comprising:

a discharge energy source;

charge switching circuitry electrically coupled to the discharge energy source, the charge switching circuitry configured to control the charging of the discharge energy source upon validation of a first signal;

first fire circuitry electrically coupled to the discharge energy source, the first fire circuitry configured to detachably couple to a first terminal of the detonation device and to discharge the discharge energy source to the first terminal;

signal verification circuitry electrically coupled to the first fire circuitry, the signal verification circuitry configured to allow the first fire circuitry to discharge the discharge energy source upon validation of a second signal; and second fire circuitry electrically coupled to the signal verification circuitry, the second fire circuitry configured to detachably couple to a second terminal of the detonation device and to activate the detonation device by allowing the discharge energy source to discharge from the first terminal to the second terminal through the detonation device upon validation of the second signal.

2. The electronic switching device of claim 1, wherein the second fire circuitry comprises a delay element configured to control the timing of the activation of the detonation device.

3. The electronic switching device of claim 2, wherein the delay element comprises a field-effect transistor having a predetermined internal gate capacitance.

4. The electronic switching device of claim 1, wherein the discharge energy source comprises capacitive circuitry.

5. The electronic switching device of claim 1, further comprising a microcontroller electrically coupled to the discharge energy source, the charge switching circuitry and the signal verification circuitry, wherein the microcontroller is configured to validate the first signal and the second signal.

6. The electronic switching device of claim 5, wherein the microcontroller is further configured to discharge the discharge energy source to ground upon detecting at least one parameter that is invalid.

7. The electronic switching device of claim 6, wherein the at least one parameter is selected from the group comprising a voltage level of the first signal, a bandwidth of the first signal, a voltage level of the second signal, a bandwidth of the second signal, a built-in test of the microcontroller, a voltage across the detonation device, a charge in the discharge energy source, and an operating mode.

8. The electronic switching device of claim 5, further comprising a detonator monitoring circuit electrically coupled to the microcontroller, the detonator monitoring circuit configured to measure a differential voltage across a first terminal and a second terminal of the detonation device.

9. An electronic switching device configured to activate a detonation device, the electronic switching device comprising:

a discharge energy source;

charge switching circuitry electrically coupled to the discharge energy source, the charge switching circuitry configured to control the charging of the discharge energy source upon validation of a first signal;

first fire circuitry electrically coupled to the discharge energy source, the first fire circuitry configured to discharge the discharge energy source; and signal verification circuitry electrically coupled to the first fire circuitry, the signal verification circuitry configured to allow the first fire circuitry to discharge the discharge energy source upon validation of a second signal;

a microcontroller electrically coupled to the discharge energy source, the charge switching circuitry and the signal verification circuitry, wherein the microcontroller is configured to validate the first signal and the second signal; and voltage converting circuitry electrically coupled to the microcontroller, the voltage converting circuitry comprising:

a power supply configured to receive the first signal and to convert the first signal to a third signal, wherein the third signal is configured to provide power to the microcontroller; and lag circuitry configured to provide a fourth signal to the microcontroller when the third signal reaches a predetermined steady-state level, wherein the fourth signal is configured to place the microcontroller in an operational mode.

10. The electronic switching device of claim 9, further comprising over-voltage protection circuitry configured to limit a voltage level of the third signal.

11. The electronic switching device of claim 9, further comprising visible indicia of the third signal.

12. The electronic switching device of claim 9, wherein the microcontroller is further configured to discharge the discharge energy source to ground upon detecting at least one parameter that is invalid.

13. The electronic switching device of claim 12, wherein the at least one parameter is selected from the group comprising a voltage level of the first signal, a bandwidth of the first signal, a voltage level of the second signal, a bandwidth of the second signal, a built-in test of the microcontroller, a voltage across the detonation device, a charge in the discharge energy source, and an operating mode.

14. The electronic switching device of claim 13, further comprising status output circuitry electrically coupled to the microcontroller, the status output circuitry configured to provide information external to the electronic switching device that is related to the at least one parameter.

15. The electronic switching device of claim 9, further comprising a detonator monitoring circuit electrically coupled to the microcontroller, the detonator monitoring circuit configured to measure a differential voltage across a first terminal and a second terminal of the detonation device.

16. The electronic switching device of claim 9, wherein the discharge energy source comprises capacitive circuitry.

17. The electronic switching device of claim 9, wherein the first fire circuitry is further configured to detachably couple to a first terminal of the detonation device and to discharge the discharge energy source to the first terminal.

18. The electronic switching device of claim 17, further comprising second fire circuitry electrically coupled to the signal verification circuitry, the second fire circuitry configured to detachably couple to a second terminal of the detonation device and to activate the detonation device by allowing the discharge energy source to discharge from the first terminal to the second terminal through the detonation device upon validation of the second signal.

19. The electronic switching device of claim 18, wherein the second fire circuitry comprises a delay element configured to control the timing of the activation of the detonation device.

20. An electronic switching device configured to activate a detonation device, the electronic switching device comprising:

a discharge energy source;

charge switching circuitry electrically coupled to the discharge energy source, the charge switching circuitry configured to control the charging of the discharge energy source upon validation of a first signal;

first fire circuitry electrically coupled to the discharge energy source, the first fire circuitry configured to discharge the discharge energy source;

signal verification circuitry electrically coupled to the first fire circuitry, the signal verification circuitry configured to allow the first fire circuitry to discharge the discharge energy source upon validation of a second signal; and blocking circuitry electrically coupled to the signal verification circuitry, the blocking circuitry configured to receive the second signal and to limit a characteristic of the second signal as it is received by the electronic switching device, wherein the characteristic is selected from the group comprising a maximum voltage level of the second signal, a maximum current level of the second signal, and a noise level of the second signal.

21. The electronic switching device of claim 20, wherein the discharge energy source comprises capacitive circuitry.

22. The electronic switching device of claim 20, wherein the first fire circuitry is further configured to detachably couple to a first terminal of the detonation device and to discharge the discharge energy source to the first terminal.

23. The electronic switching device of claim 22, further comprising second fire circuitry electrically coupled to the signal verification circuitry, the second fire circuitry configured to detachably couple to a second terminal of the detonation device and to activate the detonation device by allowing the discharge energy source to discharge from the first terminal to the second terminal through the detonation device upon validation of the second signal.

24. The electronic switching device of claim 23, wherein the second fire circuitry comprises a delay element configured to control the timing of the activation of the detonation device.

25. The electronic switching device of claim 20, further comprising a microcontroller electrically coupled to the discharge energy source, the charge switching circuitry and the signal verification circuitry, wherein the microcontroller is configured to validate the first signal and the second signal.

26. The electronic switching device of claim 25, wherein the microcontroller is further configured to discharge the discharge energy source to ground upon detecting at least one parameter that is invalid.

27. The electronic switching device of claim 26, wherein the at least one parameter is selected from the group comprising a voltage level of the first signal, a bandwidth of the first signal, a voltage level of the second signal, a bandwidth of the second signal, a built-in test of the microcontroller, a voltage across the detonation device, a charge in the discharge energy source, and an operating mode.

28. The electronic switching device of claim 25, further comprising a detonator monitoring circuit electrically coupled to the microcontroller, the detonator monitoring circuit configured to measure a differential voltage across a first terminal and a second terminal of the detonation device.

* * * * *

UNITED STATES PATENT AND TRADEMARK OFFICE

CERTIFICATE OF CORRECTION

PATENT NO. : 6,992,877 B2
APPLICATION NO. : 10/386578
DATED : January 31, 2006
INVENTOR(S) : Derek DeVries et al.

It is certified that error appears in the above-identified patent and that said Letters Patent is hereby corrected as shown below:

In Drawings - Delete drawing sheets 3, 5, 6, 8, 13, 14, 16, 24 and 31 of 33. Substitute the attached replacement sheets therefor.

In the specification:

COLUMN 11, LINE 13, change "DELAY5 Routine"" to --"DELAY5 Routine"--

Signed and Sealed this

Thirteenth Day of July, 2010

David J. Kappos

David J. Kappos
*Director of the United States Patent and Trademark Office*